US006804476B2

(12) United States Patent
Yokoi et al.

(10) Patent No.: US 6,804,476 B2
(45) Date of Patent: Oct. 12, 2004

(54) PROCESS CARTRIDGE AND DEVELOPING DEVICE DETACHABLY ATTACHABLE TO IMAGE FORMING APPARATUS MAIN BODY AND HAVING DEVELOPER SEAL MEMBER WITH GRIP PORTION, AND SUCH IMAGE FORMING APPARATUS

(75) Inventors: Akiyoshi Yokoi, Shizuoka (JP); Toru Oguma, Shizouka (JP); Masataka Mochizuki, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/372,401

(22) Filed: Feb. 25, 2003

(65) Prior Publication Data

US 2003/0161644 A1 Aug. 28, 2003

(30) Foreign Application Priority Data

Feb. 28, 2002 (JP) ..... 2002-052730

(51) Int. Cl.[7] ..... G03G 15/08; G03G 15/00

(52) U.S. Cl. ..... 399/27; 399/90; 399/103

(58) Field of Search ..... 399/13, 27, 90, 399/102, 103, 106

(56) References Cited

U.S. PATENT DOCUMENTS

| | | | | | |
|---|---|---|---|---|---|
| 5,455,665 | A | | 10/1995 | Baba et al. | 355/298 |
| 5,768,658 | A | | 6/1998 | Watanabe et al. | 399/111 |
| 5,790,923 | A | | 8/1998 | Oguma et al. | 399/106 |
| 5,812,909 | A | | 9/1998 | Oguma et al. | 399/103 |
| 5,937,237 | A | * | 8/1999 | Nonaka et al. | 399/106 |
| 5,940,658 | A | | 8/1999 | Yokoi et al. | 399/119 |
| 6,088,552 | A | * | 7/2000 | Morinaga et al. | 399/106 |
| 6,097,909 | A | | 8/2000 | Watanabe et al. | 399/111 |
| 6,122,458 | A | * | 9/2000 | Kita et al. | 399/27 |
| 6,144,821 | A | | 11/2000 | Oguma | 399/114 |
| 6,178,302 | B1 | * | 1/2001 | Nagashima et al. | 399/106 |
| 6,253,036 | B1 | | 6/2001 | Karakama et al. | 399/27 |
| 6,266,500 | B1 | | 7/2001 | Numagami et al. | 399/104 |
| 6,272,299 | B1 | | 8/2001 | Numagami et al. | 399/111 |
| 6,301,457 | B1 | * | 10/2001 | Chadani et al. | 399/106 X |
| 6,377,759 | B1 | | 4/2002 | Abe et al. | 399/27 |
| 6,463,223 | B1 | | 10/2002 | Karakama et al. | 399/27 |
| 6,512,895 | B2 | | 1/2003 | Sakurai | 399/13 |
| 2001/0017990 | A1 | | 8/2001 | Oguma et al. | 399/27 |
| 2001/0038758 | A1 | | 11/2001 | Oguma et al. | 399/27 |
| 2002/0012542 | A1 | | 1/2002 | Karakama et al. | 399/27 |
| 2002/0021908 | A1 | | 2/2002 | Matsumoto et al. | 399/27 |
| 2002/0025177 | A1 | | 2/2002 | Yokoi et al. | 399/27 |
| 2002/0064930 | A1 | | 5/2002 | Ishikawa | 438/612 |
| 2002/0067930 | A1 | | 6/2002 | Oguma et al. | 399/222 |
| 2002/0122674 | A1 | | 9/2002 | Yokoi et al. | 399/113 |
| 2002/0131789 | A1 | | 9/2002 | Yokoi et al. | 399/103 |
| 2002/0131791 | A1 | | 9/2002 | Yokoi et al. | 399/113 |
| 2002/0172521 | A1 | | 11/2002 | Oguma et al. | 399/27 |

FOREIGN PATENT DOCUMENTS

| | | |
|---|---|---|
| JP | 9-197945 | 7/1997 |

* cited by examiner

*Primary Examiner*—Sandra L. Brase
(74) *Attorney, Agent, or Firm*—Fitzpatrick, Cella, Harper & Scinto

(57) ABSTRACT

A process cartridge detachably attachable to an image forming apparatus main body has a developer storing container with a supplying opening portion through which developer is supplied to a developing member, a developer seal member removably attached to the developer storing container, a grip portion for pulling out the developer seal member, and a contact portion electrically connected to a main body electrical contact of the image forming apparatus main body when the process cartridge is attached to the image forming apparatus main body. In this process cartridge, the grip portion covers the contact portion to cut an electrical connection between the contact portion and the main body electrical contact in the case that the process cartridge is attached to the image forming apparatus main body without removing the developer seal member. In this way, the developer seal member that is removably attached to the developer storing container can be pulled out without fail.

20 Claims, 18 Drawing Sheets

| FIG. 11A | FIG. 11B |
|---|---|

| FIG. 12A | FIG. 12B |
|---|---|

| FIG. 13A | FIG. 13B |
|---|---|

| FIG. 14A | FIG. 14B |
|---|---|

PROCESS CARTRIDGE AND DEVELOPING DEVICE DETACHABLY ATTACHABLE TO IMAGE FORMING APPARATUS MAIN BODY AND HAVING DEVELOPER SEAL MEMBER WITH GRIP PORTION, AND SUCH IMAGE FORMING APPARATUS

BACKGROUND OF THE INVENTION

1. Field of the Invention

The present invention relates to a process cartridge detachably attachable to an image forming apparatus main body, a developing device, and image forming apparatus to which the process cartridge or the developing device is detachably attachable.

The term image forming apparatus here means one that forms an image on a recording medium using the electrophotography image forming process, and includes electrophotographic copying machines, electrophotographic printers (such as laser beam printers and LED printers), fax machines, word processors, etc.

A "process cartridge" refers to a cartridge obtained by integrating electrophotographic photosensitive drum with at least developing means so as to be detachably attachable to an image forming apparatus main body.

2. Related Background Art

Image forming apparatus using the electrophotography image forming process forms a latent image by irradiating an electrophotographic photosensitive member with light according to image information, visualizes an image from this latent image by supplying developing means with developer that is a recording material, and then forms the image on a recording medium by transferring the image from the electrophotographic photosensitive member onto the recording medium.

Such image forming apparatus employs a process cartridge method in which an electrophotographic photosensitive member and process means working over the electrophotographic photosensitive member are integrated to make a cartridge, or at least an electrophotographic photosensitive member and developing means are integrated to make a cartridge, and the cartridge is detachably attachable to an image forming apparatus main body. The process cartridge method allows a user to perform maintenance work of the apparatus by himself/herself, thereby improving the operability greatly. The process cartridge method is widely used in image forming apparatuses.

This type of process cartridge has a developing container for holding and receiving a developer carrying member that gives an electrophotographic photosensitive member developer, as well as a developer storing container for storing developer to be supplied to the developing container, and uses a developer seal member for separating the developing container and the developer storing container from each other in order to seal the developer in the developer storing container and prevent the developer from being sprayed until time of use. The developer seal member is structured such that it can be removed when the time comes to use the process cartridge. The developer seal member is pulled out of the cartridge before the process cartridge is attached to the image forming apparatus main body. This opens an opening portion of the developer storing container that stores developer to make the developer available to the developing container and the developer carrying member.

In image forming apparatus of process cartridge method, developer stored in a developer storing container inside a cartridge is consumed by forming an image. When the developer is spent, a user replaces the old process cartridge with new one to allow the apparatus to form an image again. Therefore it is necessary to notify, as the need arises, a user of how much of the developer remains in the cartridge and is available for image forming. In many cases, a process cartridge or image forming apparatus is provided with developer amount detecting means that can detect the remaining developer level consecutively in order to recommend a user to prepare a new cartridge and change properly and efficiently as the developer in the current cartridge is running out.

In the above-described process cartridge using a developer seal member which separates a developing container and a developer storing container from each other to seal developer in the developer storing container, the developer seal member must be pulled out of the cartridge upon the arrival of time of use. If, by mistake, the process cartridge is attached to the image forming device main body without pulling out the developer seal member, image output cannot be obtained because no developer is supplied to a developer carrying member and an electrophotographic photosensitive member when the image forming apparatus is turned on.

In order to avoid this situation, a measure disclosed in Japanese Patent Application Laid-Open No. 09-197945 has been proposed as means for detecting the presence or absence of a developer seal member. The means disclosed in this publication which detects the presence or absence of a developer seal member has, in a cartridge attachment portion of the apparatus main body, a light emitting portion and light receiving portion of a photointerrupter for detecting the presence or absence of a developer seal member in a process cartridge. In the case that the process cartridge is attached to the apparatus and main body and the developer seal member is not pulled out of the process cartridge, light from the light emitting portion is blocked by the developer seal member and does not reach the light receiving portion. A detecting circuit connected to the photointerrupter of the apparatus main body thus detects that the developer seal member is not pulled out. Further, based on the detection result, the fact that the developer seal member has not been pulled out is displayed in, for example, a display unit of the apparatus main body to notify a user of the fact.

However, the detecting means disclosed in the publication needs to provide the apparatus main body with the photointerrupter having the light emitting portion and the light receiving portion and with the detecting circuit of the photointerrupter. This addition of parts and circuits makes the structure expensive.

Another method is to affix a projecting member at an end (an end in the pulling-out direction) of a developer seal member to physically prevent a process cartridge from entering image forming apparatus main body unless the developer seal member is pulled out. However, this method requires a fairly large projecting member in order to make sure that the process cartridge cannot enter the image forming apparatus main body.

SUMMARY OF THE INVENTION

An object of the present invention is to provide a developing device, process cartridge, and image forming apparatus capable of detecting, without fail, a developer seal member which is removably attached to a developer storing container to block a supplying opening portion and seal developer in the developer storing container and which should be pulled out to open the supplying opening portion and make the developer available to a developing member but is accidentally left in place without being pulled out.

Another object of the present invention is to provide a developing device, process cartridge, and image forming apparatus capable of detecting, without fail, with no need for dedicated detecting means, a developer seal member which is removably attached to a developer storing container to block a supplying opening portion and seal developer in the developer storing container and which should be pulled out to open the supplying opening portion and make the developer available to a developing member but is accidentally left in place without being pulled out.

Further, another object of the present invention is to provide a developing device, process cartridge, and image forming apparatus which do not start image forming operations when the developing device or the process cartridge is attached to the image forming apparatus main body without removing a developer seal member.

Still further, another object of the present invention is to provide a developing device, process cartridge, and image forming apparatus capable of detecting a developer seal member which is accidentally left without being pulled out when the developing device or the process cartridge is attached to the image forming apparatus main body without removing the developer seal member.

Yet further, another object of the present invention is to provide a process cartridge detachably attachable to an image forming apparatus main body, including: an electrophotographic photosensitive drum; a developing member for developing a latent image formed on the electrophotographic photosensitive drum; a developer storing container which stores developer for developing the latent image of the electrophotographic photosensitive drum and which has a supplying opening portion for supplying the developer to the developing member; a developer seal member removably attached to the developer storing container so that the developer is sealed in the developer storing container by blocking the supplying opening portion with the developer seal member and is made available to the developing member by removing the developer seal member from the supplying opening portion; a grip portion placed on one end in the longitudinal direction of the developer seal member in order to pull out the developer seal member and open the supplying opening portion; a measuring electrode member for detecting the amount of the developer in the process cartridge; and a contact portion electrically connected to a main body electrical contact of the image forming apparatus main body when the process cartridge is attached to the image forming apparatus main body, the contact portion relaying, to the main body electrical contact, a signal sent from the measuring electrode member in accordance with the amount of the developer so that the image forming apparatus main body can detect the developer amount, in which in the case that the process cartridge is attached to the image forming apparatus main body without removing the developer seal member, the grip portion covers the contact portion to cut an electrical connection between the contact portion and the main body electrical contact.

Furthermore, another object of the present invention is to provide a developing device detachably attachable to an image forming apparatus main body, including: a developing member for developing a latent image formed on the electrophotographic photosensitive drum; a developer storing container which stores developer for developing the latent image of the electrophotographic photosensitive drum and which has a supplying opening portion for supplying the developer to the developing member; a developer seal member removably attached to the developer storing container so that the developer is sealed in the developer storing container by blocking the supplying opening portion with the developer seal member and is made available to the developing member by removing the developer seal member from the supplying opening portion; a grip portion placed on one end in the longitudinal direction of the developer seal member in order to pull out the developer seal member and open the supplying opening portion; a measuring electrode member for detecting the amount of the developer in the developing device; and a contact portion electrically connected to a main body electrical contact of the image forming apparatus main body in the case that the developing device is attached to the image forming apparatus main body, the contact portion relaying, to the main body electrical contact, a signal sent from the measuring electrode member in accordance with the amount of the developer so that the image forming apparatus main body can detect the developer amount, in which when the developing device is attached to the image forming apparatus main body without removing the developer seal member, the grip portion covers the contact portion to cut an electrical connection between the contact portion and the main body electrical contact.

Moreover, another object of the present invention is to provide an image forming apparatus with a detachable process cartridge for forming an image on a recording medium, including: (i) a main body electrical contact; (ii) detecting means; (iii) an attachment portion to which the process cartridge is detachably attachable; (iv) the process cartridge attached to the attachment portion, the process cartridge including: an electrophotographic photosensitive drum; a developing member for developing a latent image formed on the electrophotographic photosensitive drum; a developer storing container which stores developer for developing the latent image of the electrophotographic photosensitive drum and which has a supplying opening portion for supplying the developer to the developing member; a developer seal member removably attached to the developer storing container so that the developer is sealed in the developer storing container by blocking the supplying opening portion with the developer seal member and is made available to the developing member by removing the developer seal member from the supplying opening portion; a grip portion placed on one end in the longitudinal direction of the developer seal member in order to pull out the developer seal member and open the supplying opening portion; a measuring electrode member for detecting the amount of the developer in the process cartridge; and a contact portion electrically connected to the main body electrical contact when the process cartridge is attached to a main body of the image forming apparatus, the contact portion relaying, to the main body electrical contact, a signal sent from the measuring electrode member in accordance with the amount of the developer so that the detecting means can detect the developer amount, the contact portion being covered with the grip portion to cut an electrical connection between the contact portion and the main body electrical contact when the process cartridge is attached to the image forming apparatus main body without removing the developer seal member; and (v) convey means for conveying the recording medium.

Further, another object of the present invention is to provide an image forming apparatus with a detachable developing device for forming an image on a recording medium, including: (i) a main body electrical contact; (ii) detecting means; (iii) an attachment portion to which the developing device is detachably attachable; (iv) the developing device attached to the attachment portion, the developing device including: an electrophotographic photosensitive drum; a developing member for developing a latent image formed on the electrophotographic photosensitive drum; a developer storing container which stores developer for developing the latent image of the electrophotographic photosensitive drum and which has a supplying opening portion for supplying the developer to the developing member; a developer seal member removably attached to the developer storing container so that the developer is sealed in the developer storing container by blocking the supplying opening portion with the developer seal member and is made available to the developing member by removing the developer seal member from the supplying opening portion; a grip portion placed on one end in the longitudinal direction of the developer seal member in order to pull out the developer seal member and open the supplying opening portion; a measuring electrode member for detecting the amount of the developer in the developing device; and a contact portion electrically connected to the main body electrical contact in the case that the developing device is attached to a main body of the image forming apparatus, the contact portion relaying, to the main body electrical contact, a signal sent from the measuring electrode member in accordance with the amount of the developer so that the detecting means can detect the developer amount, the contact portion being covered with the grip portion to cut an electrical connection between the contact portion and the main body electrical contact in the case that the developing device is attached to the image forming apparatus main body without removing the developer seal member; and (v) convey means for conveying the recording medium.

DETAILED DESCRIPTION OF THE PREFERRED EMBODIMENTS

Preferred embodiments of the present invention will be described below with reference to the drawings.

Figure 1:
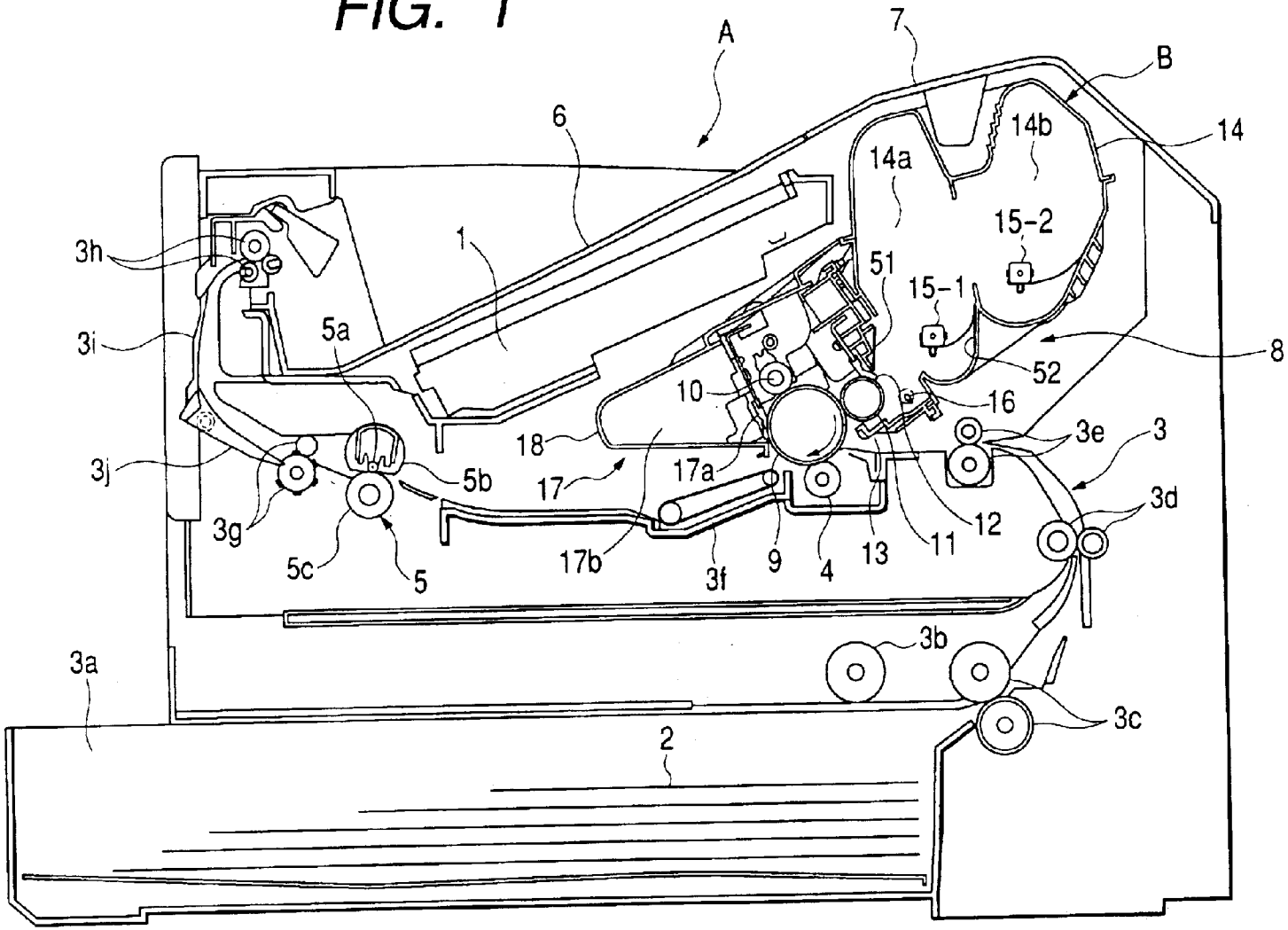
FIG. 1 is a schematic structural diagram of an embodiment of an image forming apparatus according to the present invention.
Figure 2:
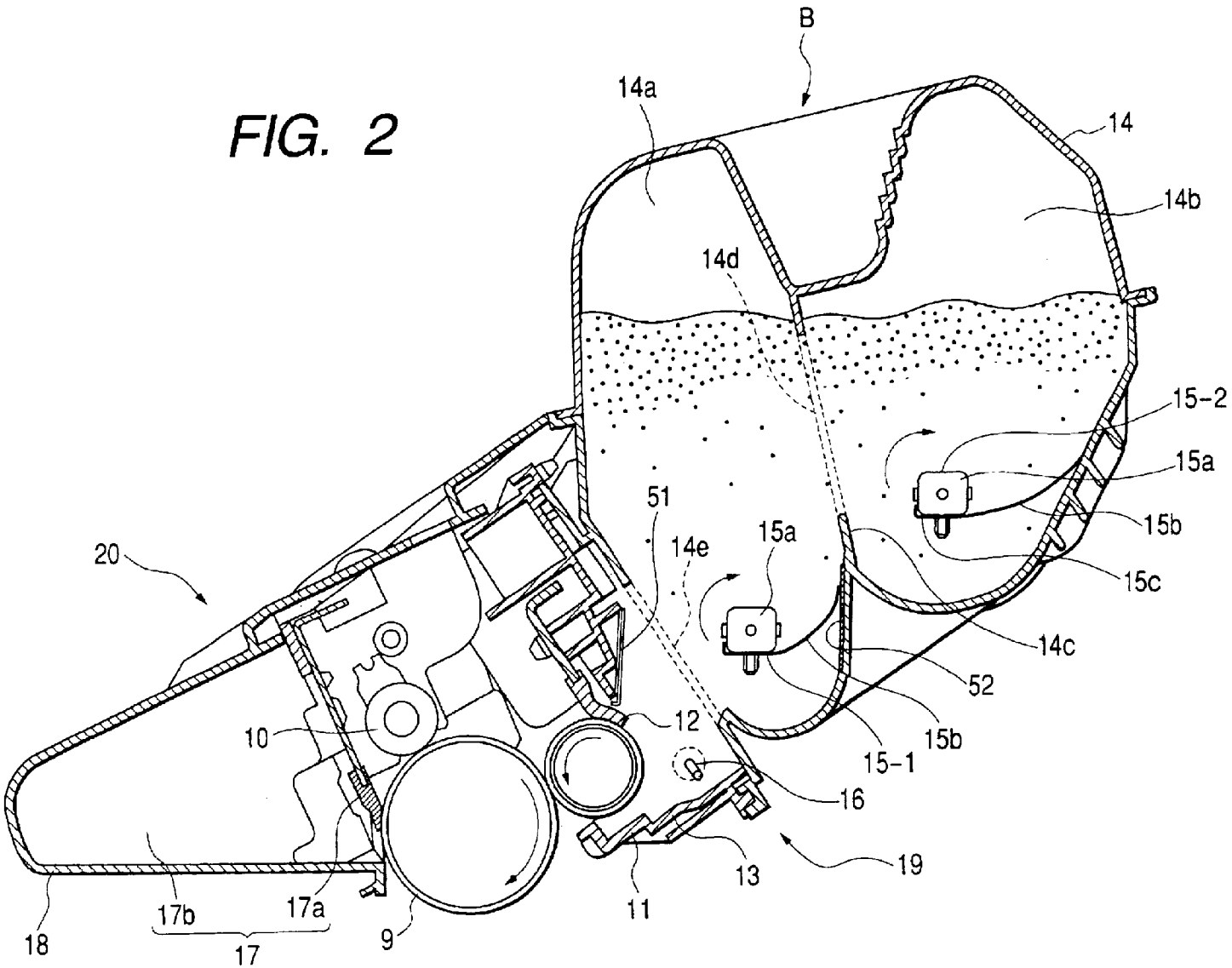
FIG. 2 is a vertical sectional view of an embodiment of a process cartridge according to the present invention.
Figure 3:
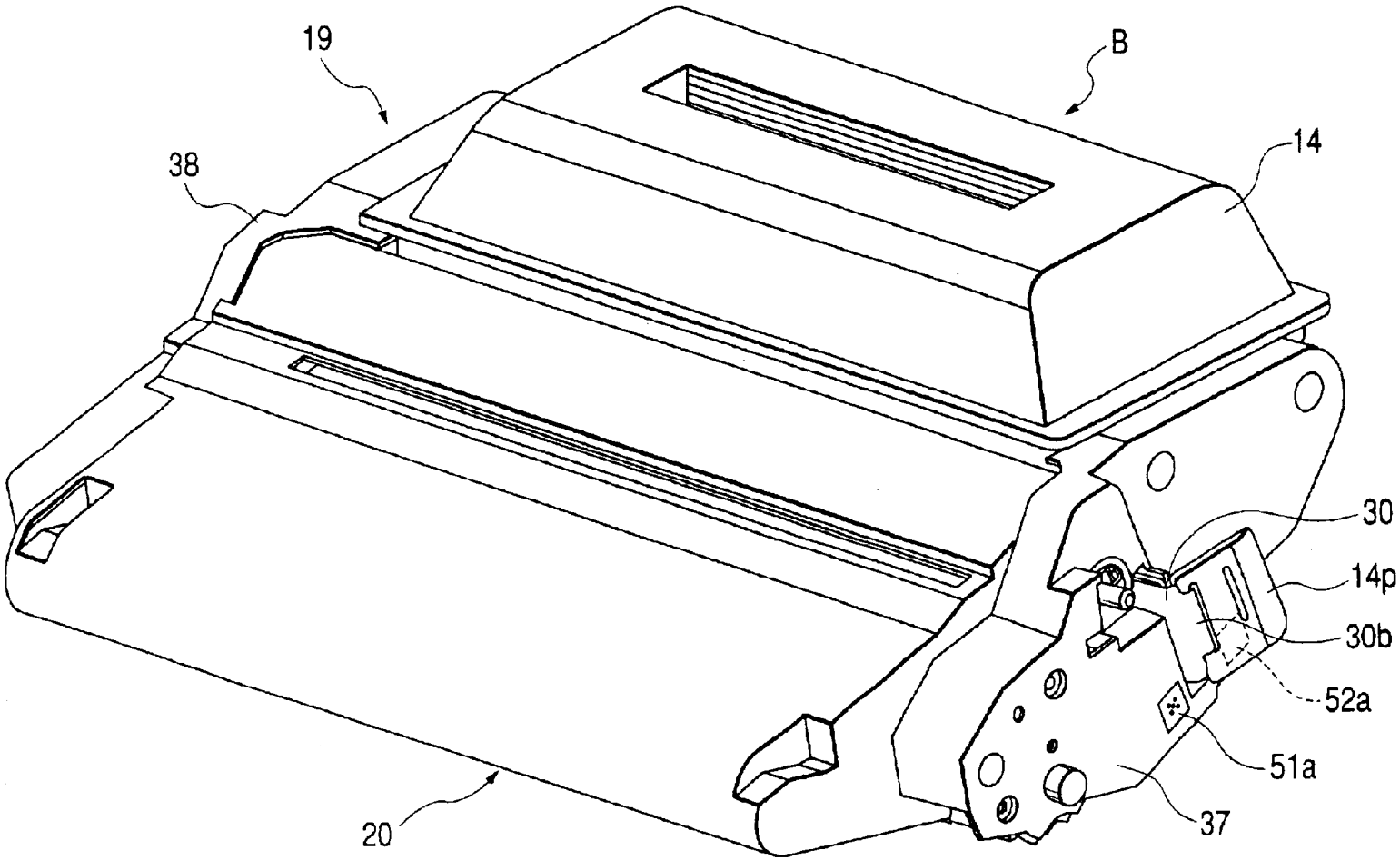
FIG. 3 is a perspective view showing the exterior of a process cartridge according to an embodiment of the present invention before the cartridge is put into use.

First, a description is given with reference to FIGS. 1 through 3 on an image forming apparatus to which a process cartridge structured in accordance with the present invention is attached detachably. The description given in this embodiment particularly takes an electrophotography method laser beam printer as an example.

An image forming apparatus A has an electrophotographic photosensitive member 9 in the form of drum (hereinafter it may be simply referred to as photosensitive drum). The photosensitive drum 9 is first charged with a charging roller 10 that serves as charging means. Then the photosensitive drum 9 is irradiated with a laser beam according to image information by optical means 1 that has a laser diode, a polygon mirror, a lens, a reflective mirror, etc. An electrostatic latent image according to the image information is thus formed on the photosensitive drum 9. The electrostatic latent image is developed by developing means using developer to obtain a visualized image, namely, a developer image.

The developer means has a developing sleeve 11 which is a developer carrying member with a built-in magnet roller, and a developing blade 12 which gives triboelectric charges to developer on the surface of the developing sleeve 11 and which serves as a developer amount regulating member for forming a developer layer of a given thickness. The developing sleeve 11 and the developing blade 12 are held in a developing container 13 that is a developing frame body. The developing container 13 is incorporated, by welding, with a developer storing container 14 for storing developer as described later to constitute a developing device unit 19.

Agitating members 15-1 and 15-2 for agitating developer and sending the developer into the developing container 13 are provided in the developer storing container 14. The agitating members 15-1 and 15-2 are rotated to send the developer in the developer storing container 14 out to the developing sleeve 11 in the developing container 13. In the developing container 13, a developer agitating member 16 is provided in the vicinity of the developing sleeve 11 in order to circulate the developer in the developing container 13.

With the above-described structure, the developer stored in the developer storing container 14 is sent out to the developing container 13 as the agitating members 15-1 and 15-2 rotate. Then the developer in the developing container 13 is sent to the developing sleeve 11 while being agitated by the developer agitating member 16. The developer adheres to the surface of the developing sleeve 11 with a built-in magnet roller. With the rotation of the developing sleeve 11, the developer is carried to the developing blade 12 where the developer is given triboelectric charges. Then a developer layer of a given thickness is formed on the developing sleeve 11 and the developer is carried to a developing region of the photosensitive drum 9. Upon arriving at the developing region, the developer is transferred onto an electrostatic latent image on the photosensitive drum 9 to form a developer image. The developing sleeve 11 is connected to a developing bias circuit and, usually, a developing bias voltage obtained by overlapping DC voltage with AC voltage is applied to the developing sleeve 11.

In synchronization with formation of the developer image described above, a recording medium 2 set in a recording medium cassette 3*a* is conveyed to the transfer position by a pickup roller 3*b* and convey roller pairs 3*c*, 3*d*, and 3*e*. At the transfer position, a transferring roller 4 is placed as transferring means and the developer image on the photosensitive drum 9 is transferred onto the recording medium 2 by applying a voltage to the transferring roller 4.

The recording medium 2 on which the developer image is transferred is conveyed to fixing means 5 through a convey guide 3*f*. The fixing means 5 has a fixing roller 5*b* with a drive roller 5*c* and a heater 5*a* built therein, and applies heat and pressure to the passing recording medium 2 to fix the transferred developer image onto the recording medium 2. Thereafter the recording medium 2 is discharged by discharge roller pairs 3*g* and 3*h* along a reversal path 3*i* onto a discharge tray 6. The discharge tray 6 is set on the top face of the image forming apparatus A. It is also possible to discharge the recording medium 2 by operating a swingable flapper 3*j* without sending the recording medium 2 along the reversal path 3*i*. The above-described pick up roller 3*b*, convey roller pairs 3*c*, 3*d*, and 3*e*, convey guide 3*f*, and discharge roller pairs 3*g* and 3*h*, together with some other parts, constitute convey means 3 for the recording medium 2.

After transferring the developer image to the recording medium 2 by the transferring roller 4, the photosensitive drum 9 is relieved of residual developer by cleaning means 17 and is subjected to the next image forming process. The cleaning means 17 has an elastic cleaning blade 17*a*, which abuts the photosensitive drum 9, to scrape residual developer off the photosensitive drum 9 and collect it in a removed developer reservoir 17*b*.

The description given next with reference to FIGS. 2 and 3 is about a process cartridge B detachably attachable to the image forming apparatus A. The process cartridge B is composed of the developing device unit 19 and a photosensitive unit 20. In the developing device unit 19, the developing container 13, which has developing means such as the developing sleeve 11 and the developing blade 12, and the developer storing container 14, which stores developer, are integrally formed by welding or the like so that they communicate with each other through a developer supplying opening portion 14*e*. The photosensitive unit 20 has a drum frame body 18 to which the photosensitive drum 9, the cleaning means 17 including the cleaning blade 17*a*, the charging roller 10, and others are attached. The developing device unit 19 and the photosensitive unit 20 are integrated into one and made into a cartridge by being sandwiched by a side cover (L) 37 and a side cover (R) 38 from both sides as shown in FIG. 3. In FIG. 2, denoted by 51 and 52 are a first electrode and a second electrode, respectively. The electrodes serve as a measuring electrode member that constitutes developer amount detecting means, and details thereof will be described later. The first electrode 51 and the second electrode 52 are connected to contact portions 51*a* and 52*a*, respectively, and the contact portions 51*a* and 52*a* are formed on the side cover (L) 37 (see FIG. 3). FIG. 3 is an external perspective view showing a state of the process cartridge before it is put into use. In FIG. 3, a reference symbol 30 denotes a developer seal member for separating the developing container 13 and the developer storing container 14 from each other as described later.

The developer storing container 14 of the process cartridge B is, as shown in FIG. 2, composed of two storing portions: developer storing portions 14*a* and 14*b*. A bottom partition 14*c* for regulating the level at which developer is pumped from the storing portion 14*b* is formed where the bottoms of the developer storing portions 14*a* and 14*b* meet. Developer is supplied from the developer storing portion 14*b* to the developer storing portion 14*a* through an opening portion 14*d* formed above the bottom partition 14*c*. The developer storing portions 14*a* and 14*b* have therein the agitating members 15-1 and 15-2, respectively. The agitating member 15-1 in the developer storing member 14*a* adjacent to the developing container is set at a relatively lower level than the agitating member 15-2. This way, developer after passing through the opening portion 14*d* utilizing its own weight can be carried smoothly.

The agitating members 15-1 and 15-2 are each constructed of a rotary rod member 15*a*, an elastic sheet 15*b* formed of polyphenylene sulfide (PPS), and a clamp member 15*c*. The elastic sheet 15*b* is fastened to the rotary rod member 15*a* with a screw, or by adhesion, welding, thermal caulking, or other measures.

The agitating member 15-2 in the developer storing portion 14*b* rotates in the direction of the arrow shown in FIG. 2 to agitate developer in the developer storing portion 14*b* and sends the developer into the developer storing portion 14*a* through the opening portion 14*d*. Then the agitating member 15-1 in the developer storing portion 14*a* rotates in the direction of the arrow shown in FIG. 2 to agitate the developer in the developer storing portion 14*a* and sends the developer into the developing container 13 through the developer supplying opening portion 14*e*. When the rotation angle speed of the agitating member 15-1 is given as $\omega 1$ and the rotation angle speed of the agitating member 15-2 is given as $\omega 2$, $\omega 1$ is set larger than $\omega 2$ ($\omega 1 > \omega 2$). The rotation angle speed $\omega 1$ of the agitating member 15-1 in the developer storing portion 14*a* adjacent to the developing container 13 thus set faster makes it easy to supply the developer to the developing sleeve 11. On the other hand, the rotation angle speed $\omega 2$ of the agitating member 15-2 which is in far upstream side of the developing container 13 is set slow but not so slow as to stop supply of the developer to the developer storing portion 14*a*. This prevents degradation of developer due to excessive agitating at locations far from the developing sleeve 11. In this embodiment, ω1 is about twice larger than ω2. However, if it is chosen that the phases of the agitating members not be aligned at an early stage, setting ω1 to an integral multiple of ω2 should be avoided so as to keep the phases of the agitating members from matching each other.

One developer storing container 14 is thus divided by the bottom partition 14*c* into two developer storing portions 14*a* and 14*b*. The developer storing portions 14*a* and 14*b* use their respective agitating members 15-1 and 15-2 to pump the developer up to the height of the bottom partition 14*c*, thereby dispersing the weight of the developer. In this way, an increase in torque due to tapping of developer during shipping can be prevented.

As described above, the downstream side agitating member 15-1 is positioned relatively lower than the upstream side agitating member 15-2 to regulate the amount of developer sent through the opening portion 14*d* to the downstream side developer storing portion 14*a*. The rotation angle speed of the downstream side agitating member 15-1 is set faster (ω1>ω2) to prevent excessive agitating in the developer storing portion 14*b* which is in far upstream side of the developing sleeve 11, so that degradation and oversupply of developer can be avoided. This also improves circulation of developer in the downstream side developer storing portion 14*a* and stabilizes supply of developer to the developing sleeve 11.

The process cartridge B structured as above is detachably attachable, as shown in FIG. 1, to a cartridge attachment portion 8 provided in the apparatus main body of the image forming apparatus A. Formed in this cartridge attachment portion 8 are guide means (not shown in the drawing) and positioning means (not shown in the drawing). The guide means is formed on each side wall interior surface of the apparatus main body in order to guide and introduce a guided portion (not shown in the drawing) that is formed on each side wall surface of the process cartridge B. The positioning means is for positioning the process cartridge B. The side walls of the cartridge attachment portion 8 have electrical contact portions (53 and 54), which are respectively connected to the above-described first electrode 51 and second electrode 52 of the process cartridge B when the process cartridge B is attached (see FIGS. 6, 7, and 10). The electrical contact portions (53 and 54) are placed such that their positions coincide with the positions of the contact portions 51*a* and 52*a*, respectively). When a cartridge door 7 of the apparatus main body is opened and the process cartridge B is attached to the cartridge attachment portion 8, the contact portion 51*a* is electrically connected to the electrical contact portion 53 whereas 52*a* is electrically connected to 54 as will be described below.

Figure 4:
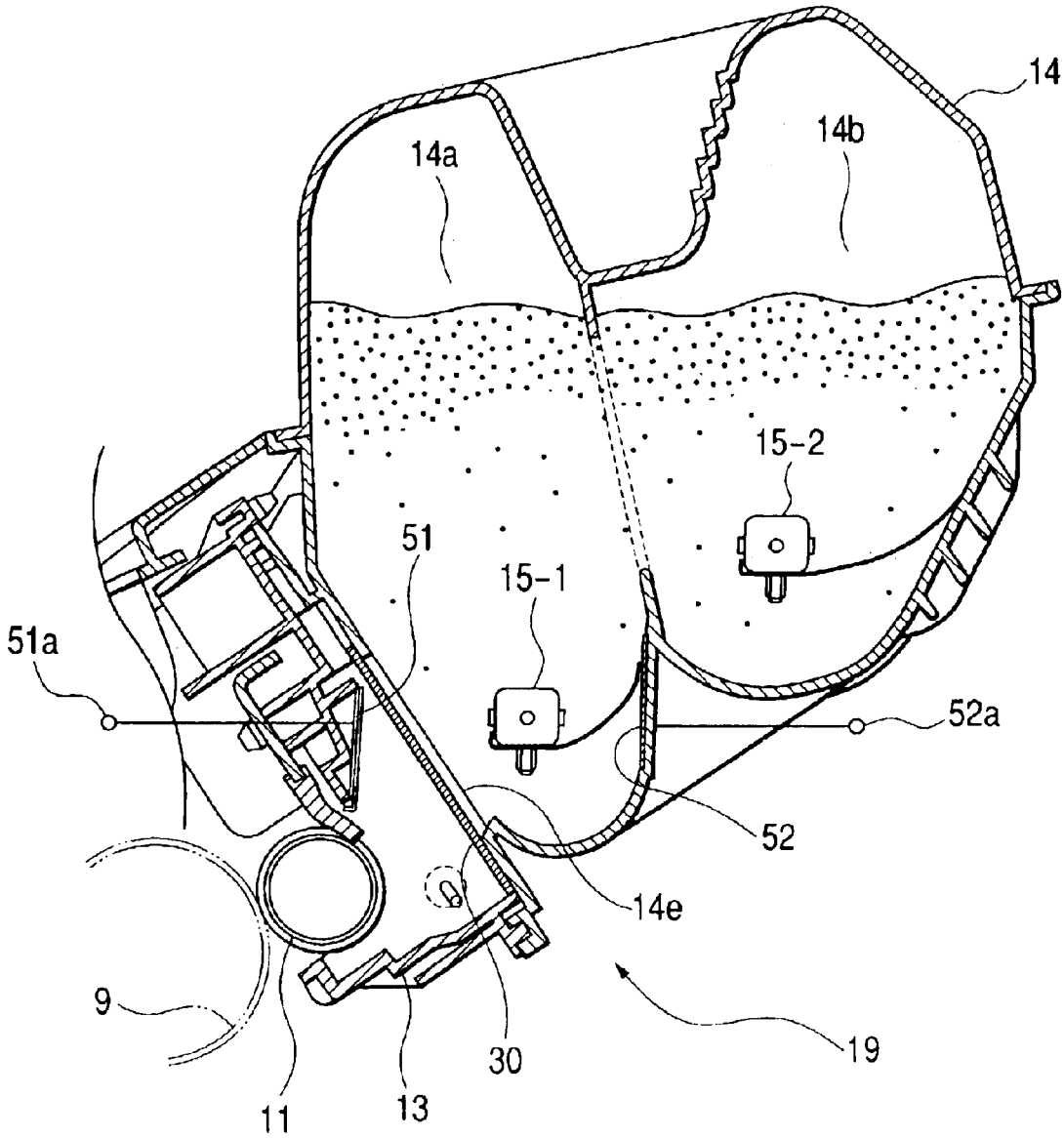
FIG. 4 is an enlarged vertical sectional view of a developing device unit in an embodiment of a process cartridge of the present invention before the unit is put into use.
Figure 5A:
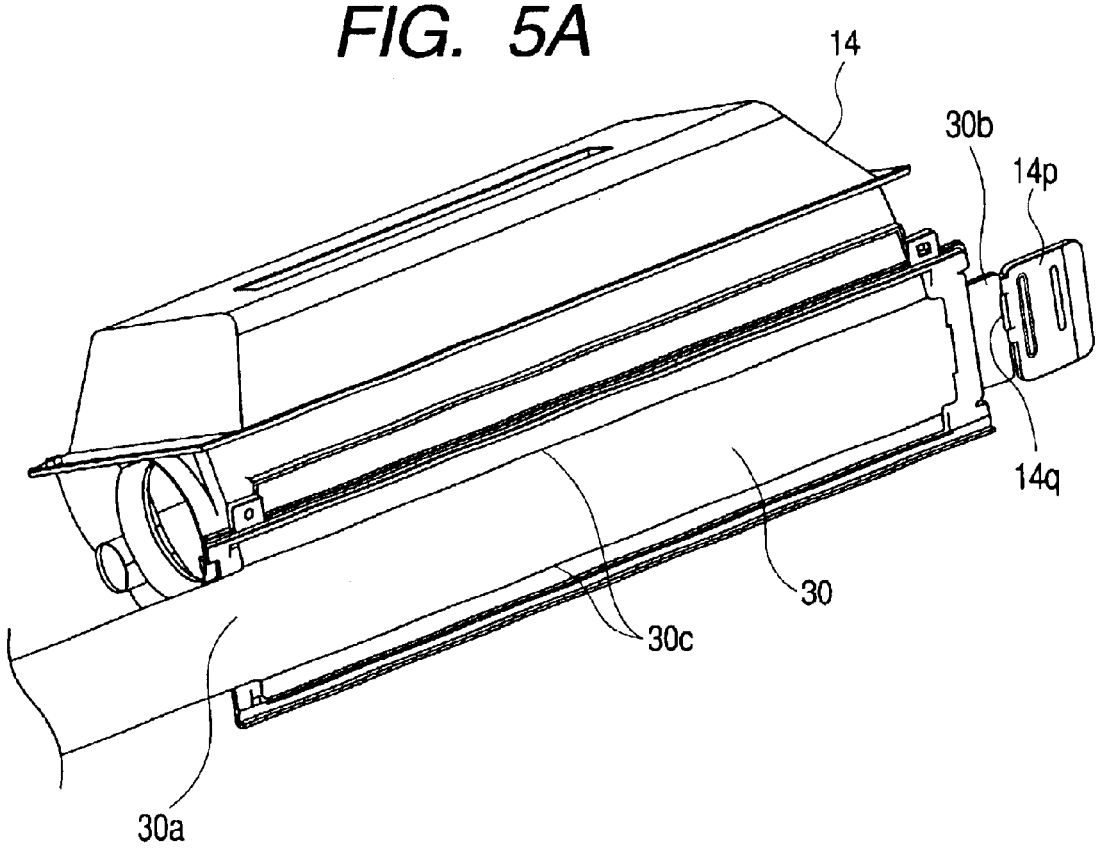
FIGS. 5A and 5B are perspective views illustrating how a developer seal member is pasted on a developer storing container in an embodiment of a process cartridge of the present invention.
Figure 5B:
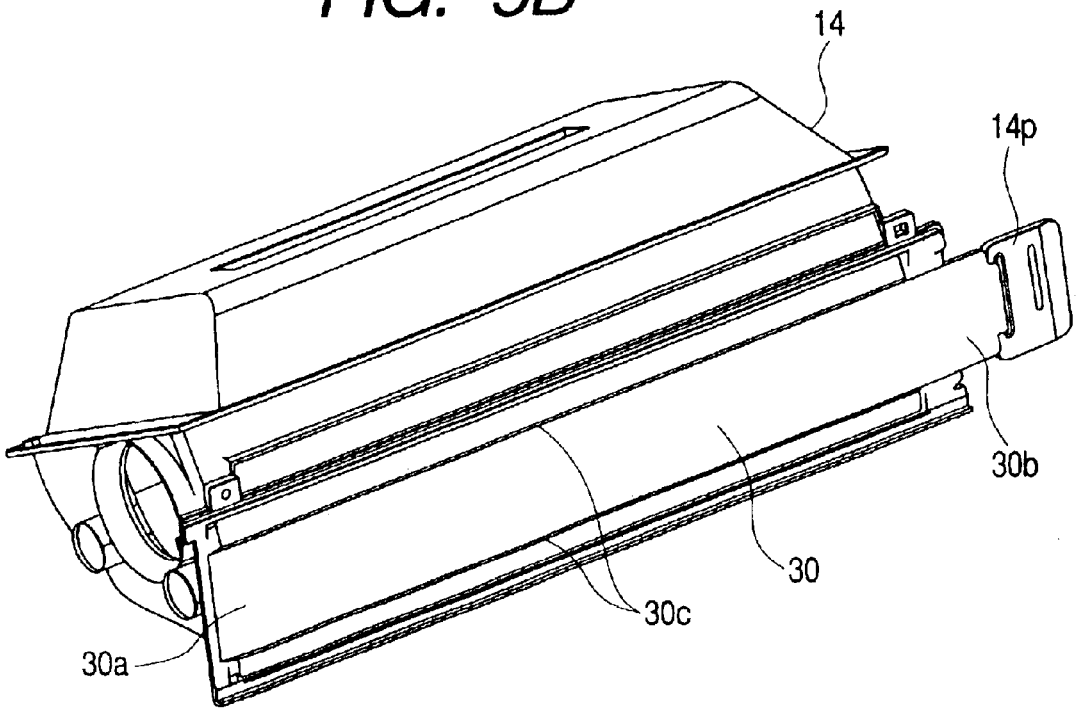

Next, a description will be given with reference to FIG. 4 and FIGS. 5A and 5B on details of the developer seal member 30 that separates the developer storing container 14 and the developing container 13 from each other in order to seal the developer storing container 14 that stores developer and prevent the developer from being sprayed until the time comes to use the process cartridge.

The developer seal member 30 separates the developer storing container 14 that stores developer and the developing container 13 from each other to seal the developer storing container 14, and is removed when the process cartridge is put into use. The developer seal member 30 is a laminate obtained by forming a polyethylene terephthalate (PET) film on each side of an aluminum (Al) film and forming a hot melt layer (sealant layer) on the attachment face. As shown in FIG. 4 and FIGS. 5A and 5B, the developer seal member 30 is pasted to the peripheral area of the developer supplying opening portion 14*e* so as to block the developer supplying opening portion 14*e* of the developer storing container 14. In the developer seal member 30, one layer of the laminated PET films has notches 30*c* at its upper and lower ends extending in the longitudinal direction as shown in FIGS. 5A and 5B. The notches 30*c* make it possible to tear off the developer seal member 30 and open the developer supplying opening portion 14*e*. Through an opening portion operation described later, the developer seal member 30 is tore along the notches 30*c* to open the developer supplying opening portion 14*e* of the developer storing container 14. As shown in FIGS. 5A and 5B, the developer seal member 30 is twice or more longer than the developer supplying opening portion 14*e* in the longitudinal direction, and substantially half its length is pasted to the peripheral area of the developer supplying opening portion 14*e* so as to block the developer supplying opening portion 14*e*. The rest of the developer seal member 30, that is, the part that is not pasted, is folded back at one end 30*a* in the longitudinal direction of the developer supplying opening portion 14*e*, overlaps the portion of the developer seal member 30 that blocks the developer supplying opening portion 14*e*, and is led outside from the other end.

When the developer storing container 14 with the developer seal member 30 pasted to the peripheral area of the developer supplying opening portion 14*e* is integrated with the developing container 13, the developer seal member 30 is pressed against a felt or other elastic seal material (not shown in the drawing) pasted to each end in the longitudinal direction of a face of the developing device 13 that opposes the developer storing container 14. Also, an end (grip end) 30*b* that runs between the developer storing container 14 and the developing container 13 to be led outside is attached to a grip member 14*p* that serves as a handhold. The grip member 14*p* and the developer storing container 14 are integrally formed, and a junction portion 14*q* where the grip member 14*p* is connected to the developer storing container 14 is made particularly thin so that the grip member 14*p* can be cut off the developer storing container 14 (see FIG. 3 and FIGS. 9A to 9C). When the process cartridge B is packed, the grip member 14*p* is bent at substantially 90° in order to reduce the entire length of the process cartridge B and improve the packing efficiency (see FIG. 3 and FIG. 9A). Immediately before a new process cartridge B is used, a user pulls up the grip member 14*p* of the developer seal member 30 to cut the grip member 14*p* off at the thin junction portion 14*q*. The user then pulls the developer seal member 30 in the direction of the arrow shown in FIG. 9B to tear off the developer seal member 30 along the notches 30*c*. The developer supplying opening portion 14*e* of the developer storing container 14 is opened in this way.

Figure 6:
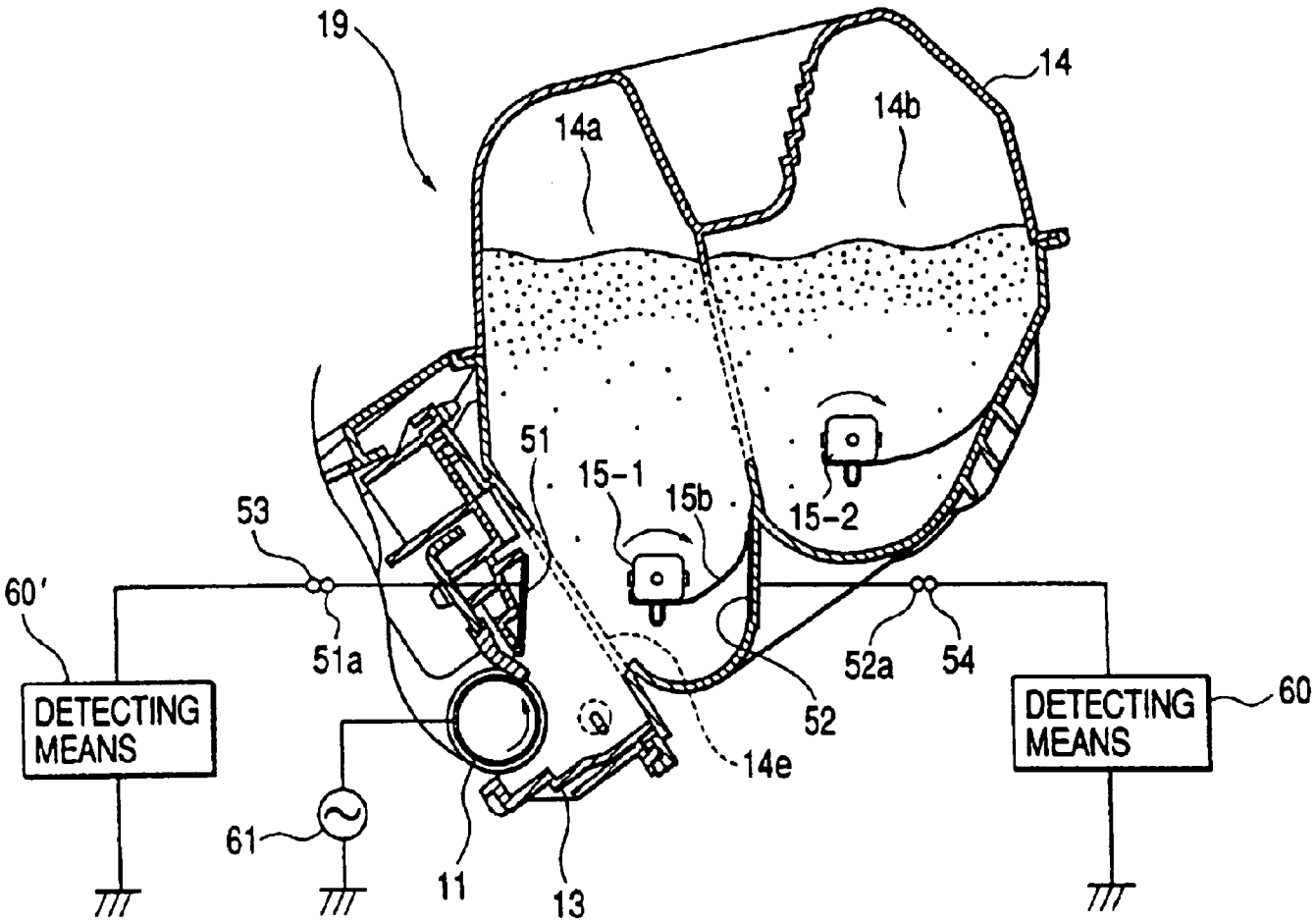
FIG. 6 is a schematic structural diagram showing developer amount detecting means in the image forming apparatus of the present invention.
Figure 7:
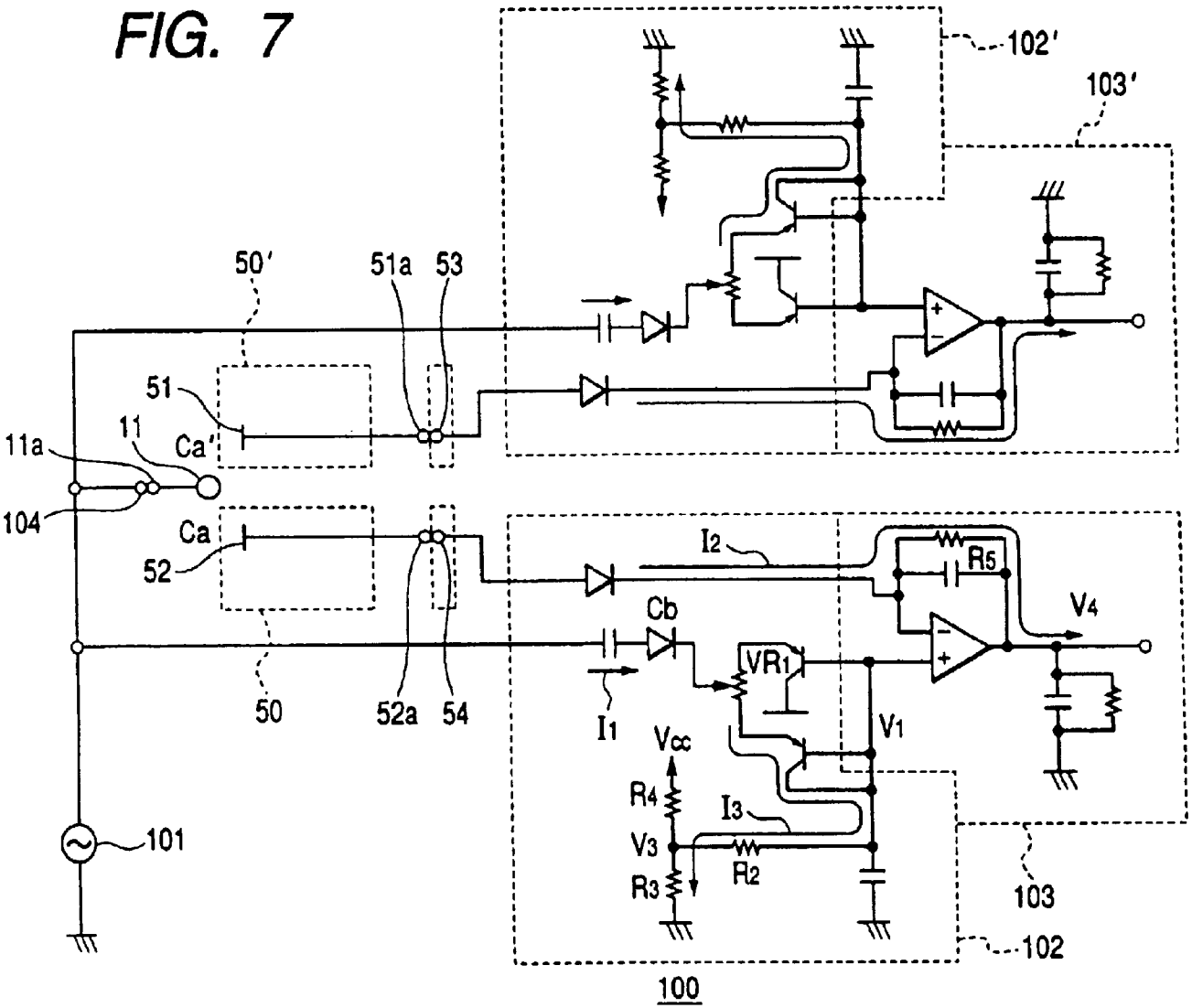
FIG. 7 is a diagram showing an example of a developer amount detecting circuit in the image forming apparatus of the present invention.
Figure 8:
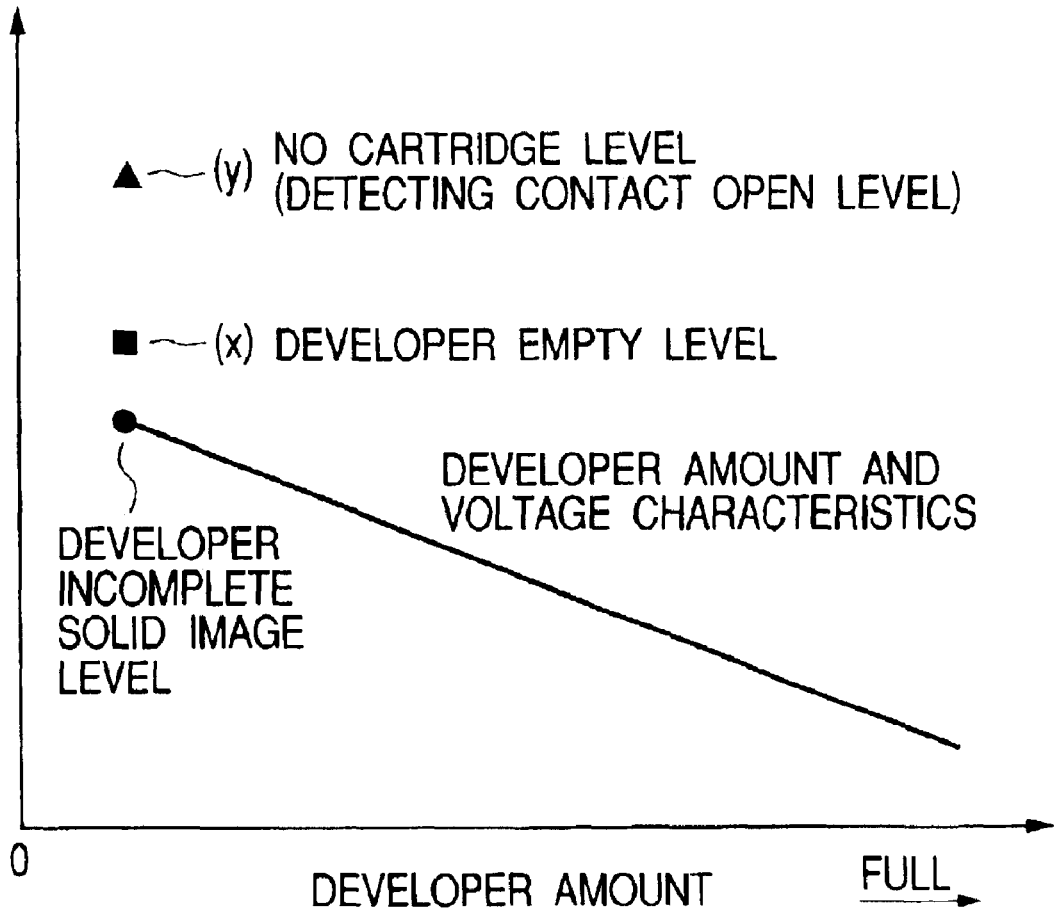
FIG. 8 is a graph showing the relation between the developer residual amount and detecting voltage detected by developer amount detecting means in the image forming apparatus of the present invention.

Described next with reference to FIGS. 6 through 8 is the developer amount detecting means (developer residual amount detecting means) as means that can detect the residual amount of developer in the developer storing container 14 and the developing container 13 consecutively as the developer is consumed.

The developer amount detecting means in this embodiment has, as clearly shown in FIG. 6, the first electrode 51 and the second electrode 52 as the measuring electrode member constituting the developer amount detecting portion in the developing container 13 and in the developer storing portion 14*a* of the developer storing container 14, respectively. The first electrode 51 and the second electrode 52 are arranged so as to face each other sandwiching the agitating member 15-1. The positional relation between the agitating member 15-1 and the second electrode 52 allows an elastic sheet 15*b* of the agitating member 15-1 to abut at least the second electrode 52 and rub against the surface of the electrode. The first electrode 51 and the second electrode 52 have an elongated shape extending along the longitudinal direction of the developing sleeve 11, and are formed from a conductive member such as a stainless steel plate. Conductive materials employable for the electrodes include, for example, stainless steel (SUS), iron, phosphorus bronze, aluminum, and conductive resin. However, a nonmagnetic metal material such as non-magnetic SUS is preferred in order not to affect circulation of developer which is magnetic.

The developing sleeve 11, the first electrode 51, and the second electrode 52 are measuring electrodes constituting the developer detecting means, and developing bias applying means 61 applies a voltage to the developing sleeve 11. As a result, capacitance is induced between the developing sleeve 11 and the first electrode 51 and between the developing sleeve 11 and the second electrode 52, separately. Then detecting means 60 connected to the second electrode 52 measures the capacitance between the developing sleeve 11 and the second electrode 52 to detect the amount of developer in the developer storing container 14 with high precision. Furthermore, the capacitance between the developing sleeve 11 and the first electrode 51 is measured by detecting means 60' connected to the first electrode 51 to detect the amount of developer in the developing container 13. From these two detection results, the amount of developer in the process cartridge B is detected very accurately.

An example of a detection circuit for use in the developer amount detecting means of this embodiment will be described next referring to FIG. 7.

In FIG. 7, a developer amount detecting portion 50 has capacitance Ca that changes in accordance with the developer amount between the developing sleeve 11 and the second electrode 52, and is connected to a control circuit 102 of a developer amount detecting circuit 100 through the electrical contact portion 52*a* and the electrical contact portion 54. Here, the contact portion 52*a* connected to the second electrode 52 is placed on the side cover (L) 37 of the process cartridge B and the electrical contact portion 54 is placed on the cartridge attachment portion 8 side of the apparatus main body. A reference capacitive element Cb is connected to a developing bias circuit 101, and sets a reference voltage $V_1$ for detecting the developer amount using an alternating current (AC current) $I_1$ that is applied through the developing bias circuit 101. Needless to say, the developing bias circuit 101 applies a developing bias voltage to the developing sleeve 11 when the process cartridge B is attached to the apparatus main body to establish an electrical connection between a contact 104 placed in the apparatus main body and an electrical contact 11*a* of the developing sleeve 11. The control circuit 102 adds an AC current $I_3$ as well as a voltage drop $V_2$ to a set voltage $V_3$ to determine the reference voltage $V_1$. The AC current $I_3$ is obtained by shunting the AC current $I_1$ that is applied to the reference capacitive element Cb, namely, reference impedance element, by a volume $VR_1$. The voltage drop $V_2$ takes place at a resistor $R_2$. The set voltage $V_3$ is set by resistors $R_3$ and $R_4$.

Accordingly, an AC current 12 applied to the developer amount detecting portion 50 is inputted to an amplifier circuit 103 and is outputted as a developer amount detection value $V_4$ ($=V_1-I_2\times R_5$). The output value $V_4$ is utilized as the detection value of the residual developer amount between the developing sleeve 11 and the second electrode 52.

A developer amount detecting portion 50' has capacitance Ca' that changes in accordance with the developer amount between the developing sleeve 11 and the first electrode 51, and is connected to a control circuit 102', which has a circuit structure similar to the one described above, through the electrical contacts 51*a* and 53. Ultimately, the detection value of the residual developer amount between the developing sleeve 11 and the first electrode 51 is outputted by an amplifier circuit 103' connected to the control circuit 102'. Here, the contact portion 51*a* connected to the first electrode 51 is placed on the side cover (L) 37 of the process cartridge B and the electrical contact 53 is placed on the cartridge attachment portion 8 side of the apparatus main body.

The relation between the voltage and developer amount detected by the developer amount detecting means that is structured as above is as shown in FIG. 8; the capacitance becomes lower and the detecting voltage level is raised as described the developer amount is reduced. This characteristic also applies to the detecting voltage detected by the first electrode 51 and the second electrode 52.

With the developer amount detecting means structured as described above, when the developer amount in the developer storing container 14 of the process cartridge B is large, there is enough developer in the space sandwiched between the developing sleeve 11 and the second electrode 52. Moreover, the developer between the developing sleeve 11 and the second electrode 52 is agitated by the agitating member 15-1 to prevent the developer from leaning to one side and keep the developer level stabilized. The capacitance between the developing sleeve 11 and the second electrode 52 therefore is kept at high level stably. As the developer is consumed by using the process cartridge B, the level of the developer between the developing sleeve 11 and the second electrode 52 is reduced. Accompanying the reduction in developer level, the capacitance between the developing sleeve 11 and the second electrode 52 is also reduced. This means that the developer amount in the developer storing portion 14*a* of the developer storing container 14 can be detected consecutively by detecting a change in capacitance between the developing sleeve 11 and the second electrode 52. When the developer is further consumed and there is no developer left in the developer storing container 14, a change in capacitance between the developing sleeve 11 and the first electrode 51 is measured to detect a change in the amount of developer in the developing container 13, that is, to detect the amount of developer in the developing container 13 with high precision. In this way, detection of the residual developer amount is continued until the process cartridge B comes to the end of its service life.

As described above, the developing sleeve 11 and the first electrode 51 are arranged such that they face the second electrode 52 with the agitating member 15-1 sandwiched therebetween. This structure makes it possible to agitate the developer between the developing sleeve 11 and the first electrode 51 and the second electrode 52 constantly by the agitating member 15-1 and prevent the developer from leaning to one side, thereby keeping the developer level stabilized. Furthermore, the elastic sheet member 15*b* of the agitating member 15-1 abuts at least the second electrode 52 to scrape off developer adhered to the surface of the second electrode 52. Therefore the residual developer amount can always be detected stably and correctly.

The capacitance between the developing sleeve 51 and the second electrode 52 as well as the capacitance between the developing sleeve 11 and the first electrode 51 are thus detected consecutively in order to detect the amount of remaining developer as the developer is consumed after the process cartridge B is attached to the cartridge attachment portion 8 of the apparatus main body and the image forming apparatus A is operated. Based on the capacitance detected, the amount of developer consumed is displayed to recommend a user to prepare a new process cartridge or a supplementary developer cartridge, and detection information of 'no developer' is displayed to prompt a user to replace the old process cartridge or supply the old process cartridge with developer.

Next, an embodiment of means for detecting the presence or absence of the developer seal member will be described with reference to FIGS. 9A to 9C and FIGS. 10 and 11.

Figure 9A:
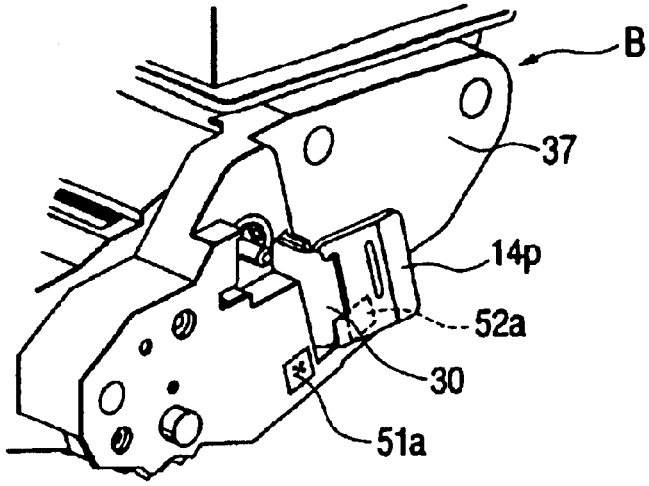
FIGS. 9A, 9B, and 9C are perspective views showing a state of a developer seal member and a contact portion of developer amount detecting means in an embodiment of a process cartridge of the present invention, with FIG. 9A showing a state before the developer seal member is pulled out, FIG. 9B showing the developer seal member being pulled out, and FIG. 9C showing a state after the developer seal member is pulled out.

The developer seal member 30 is, as described above, pasted to the peripheral area of the developer supplying opening portion 14*e* of the developer storing container 14 so as to block the opening portion, and the end (grip end) 30*b* led outside has the grip member 14*p* attached thereto. The grip member 14*p* and the developer storing container 14 are integrally formed and the grip member 14*p* is bent at substantially 90° as shown in FIG. 3 and FIG. 9A. The grip member 14*p* of the developer seal member 30 is pulled up and cut off by a user immediately before a new process cartridge B is put into use, and the user pulls the grip member 14*p* in the direction indicated by the arrow in FIG. 9B. This tears the developer seal member 30 along the notches 30*c* and the developer seal member 30 is pulled out of the process cartridge, thereby opening portion the developer supplying opening portion 14*e* of the developer storing container 14. The developer in the developer storing container 14 is supplied to the developing container 13 through the developer supplying opening portion 14*e* and now ready for use.

With this developer seal member 30, a user himself or herself has to break the seal. Therefore, if a user forgets to pull out the developer seal member 30 and inserts the process cartridge B to the image forming apparatus main body with the developer seal member 30 still blocking the developer supplying opening portion 14*e*, no image output is obtained when the image forming apparatus performs an output operation and, in addition, it can cause a problem of raised torque. Taking this embodiment as an example, if the image forming apparatus is operated without pulling out the developer seal member 30 from the process cartridge B before the cartridge is inserted to the apparatus main body, the axial torque of the above-described agitating member 15-1 takes as large a value as 2 N·m upon start-up. On the other hand, in the normal operation where the developer seal member 30 is pulled out before the process cartridge is attached, the start-up axial torque is greatly reduced and about 0.7 N·m, which is about 65% reduction.

Therefore, in this embodiment, conduction between the electrical contacts of the above-described developer detecting means is structurally cut off when the process cartridge B is attached to the apparatus main body without pulling the developer seal member 30 out. This structure makes it possible to detect the developer seal member 30 that is accidentally left in place without being pulled out from the developer amount detection value and to notify a user through notifying means, thereby avoiding the problems described above. Also, this structure does not need to newly add a special detecting member and therefore prevention of leaving the developer seal member in place accidentally without being pulled out can be achieved without increasing cost.

In this embodiment, the presence or absence of the developer seal member 30 is detected from the voltage level of a detecting voltage of each electrode which is detected by the developer residual amount detecting means. To perform this detection based on voltage level, the grip member 14*p* structured such that it can insulate the electrical contact portion 54 of the image forming apparatus main body and the contact portion 52*a* of the cartridge from each other and that it can be removed by pulling out the developer seal member 30 is particularly employed as a member that covers and masks the contact portion 52*a* connected to the second electrode 52.

In a new process cartridge B, the grip member 14*p* attached to the end (grip end) 30*b* of the developer seal member 30 which is led outside is bent so as to cover the contact portion 52*a* as shown in FIGS. 3 and 9A. The contact portion 52*a* is for connecting the second electrode 52 to the detecting means 60 and is placed on the side cover (L) 37. If the process cartridge B is attached to the apparatus main body in this state (namely, without pulling out the developer seal member 30), the contact portion 51*a* connected to the first electrode 51 is electrically connected to the electrical contact 53 on the apparatus main body side but the grip member 14*p* is interposed between the contact portion 52*a* connected to the second electrode 52 and the electrical contact 54 on the apparatus main body side to cut an electrical connection between the contact portions 52*a* and the electrical contact portion 54.

Figure 9B:
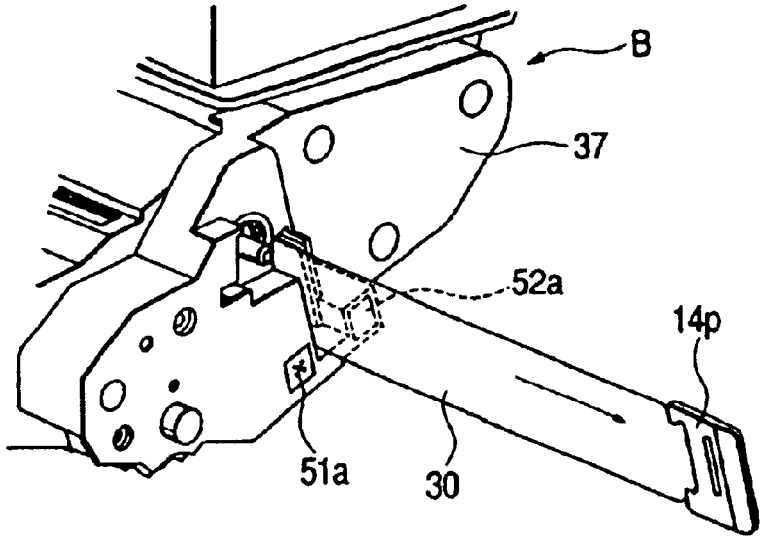
Figure 9C:
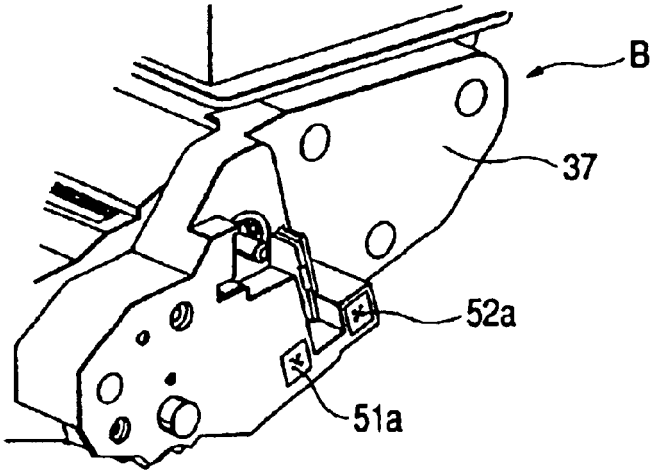

The contact portion 52*a* is exposed for the first time as shown in FIG. 9C only after the grip member 14*p* is pulled up, cut off, and pulled in the direction indicated by the arrow shown in FIG. 9B to pull out the developer seal member 30 in preparation for attaching the process cartridge B to the apparatus main body. By attaching the process cartridge B to the apparatus main body with the contact portion 52*a* exposed, the contact portion 51*a* connected to the first electrode 51 is electrically connected to the electrical contact portion 53 on the apparatus main body side and the contact portion 52*a* connected to the second electrode 52 is electrically connected to the electrical contact portion 54 on the apparatus main body side at the same time.

Figures 11, 11A:
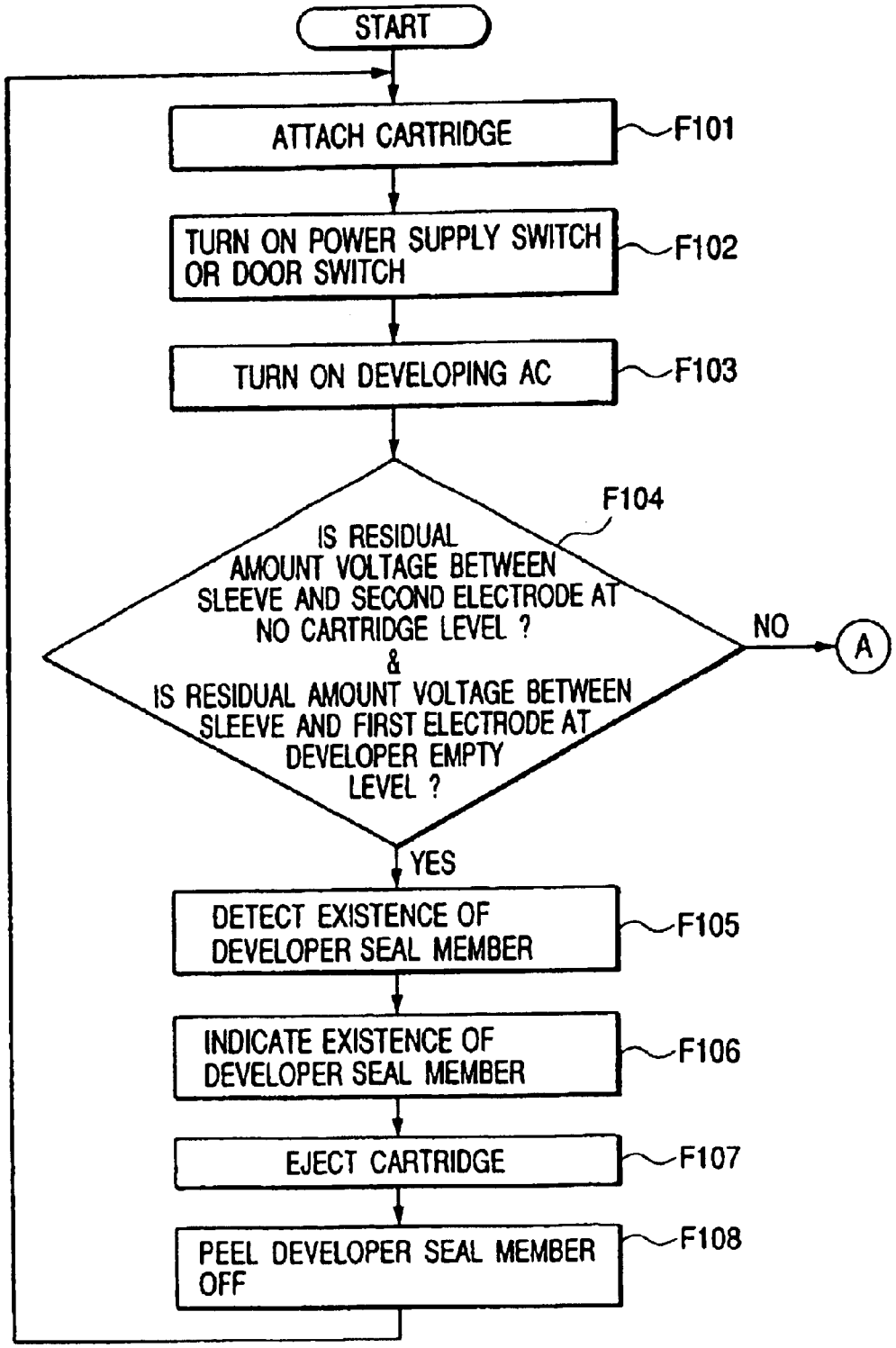
FIG. 11 is comprised of FIGS. 11A and 11B showing a flow chart illustrating a method of detecting the presence or absence of a developer seal member in the image forming apparatus of the present invention.
Figure 11B:
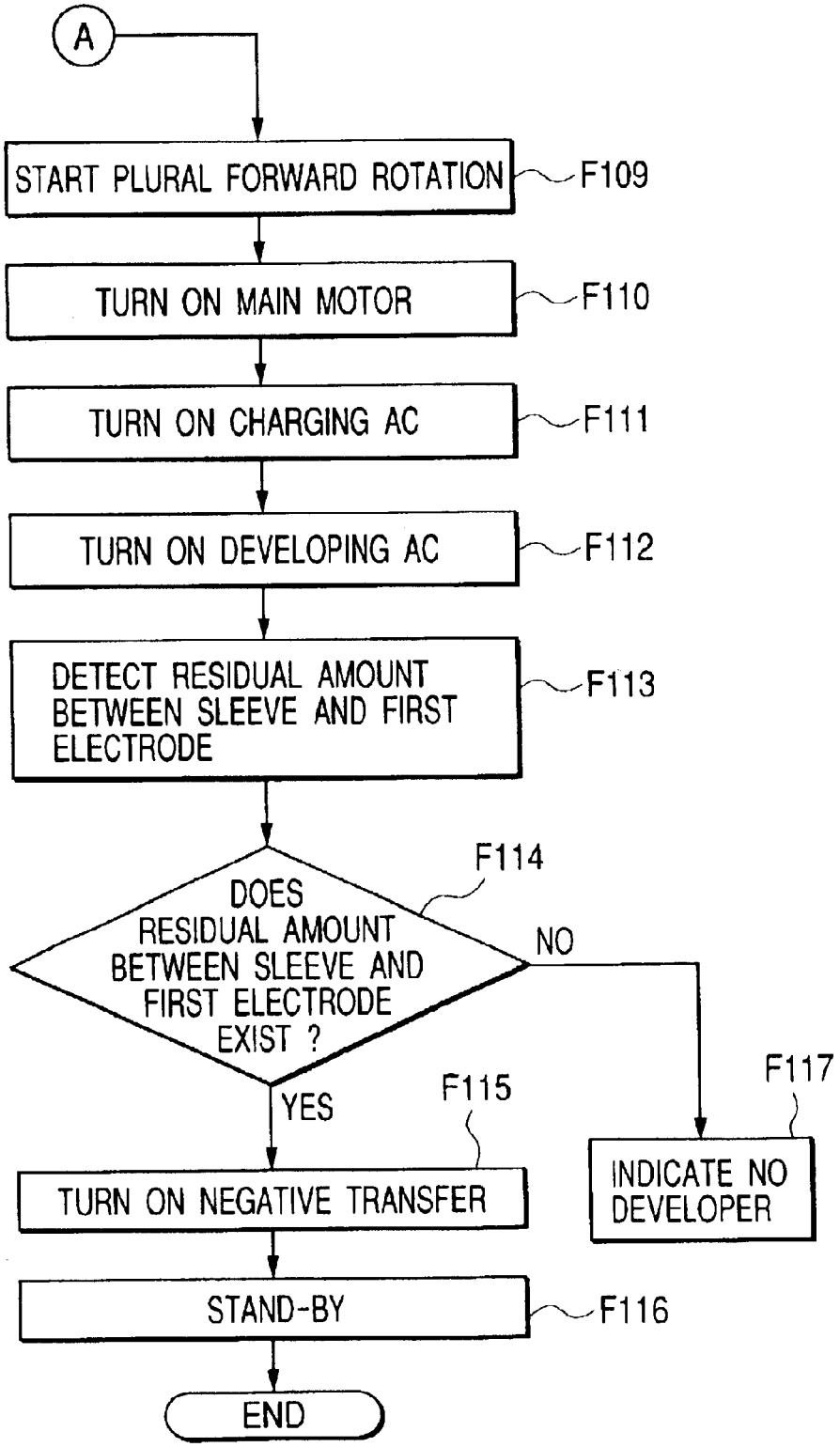

Described next referring to a flow chart of FIGS. 11A and 11B are an operation which starts with detection of the presence or absence of the developer seal member and which ends with print stand-by operation.

First, the process cartridge B is attached to the image forming apparatus main body (Step F101), a power supply switch is turned ON, or a door switch is turned ON (Step F102). This causes first a CPU to output a signal that turns a developing AC ON and a developing AC is applied (Step F103). As a result, the residual amount of the developer between the developing sleeve 11 and the first electrode 51 is detected and the residual amount of the developer between the developing sleeve 11 and the second electrode 52 is detected (Step F104).

Figure 10:
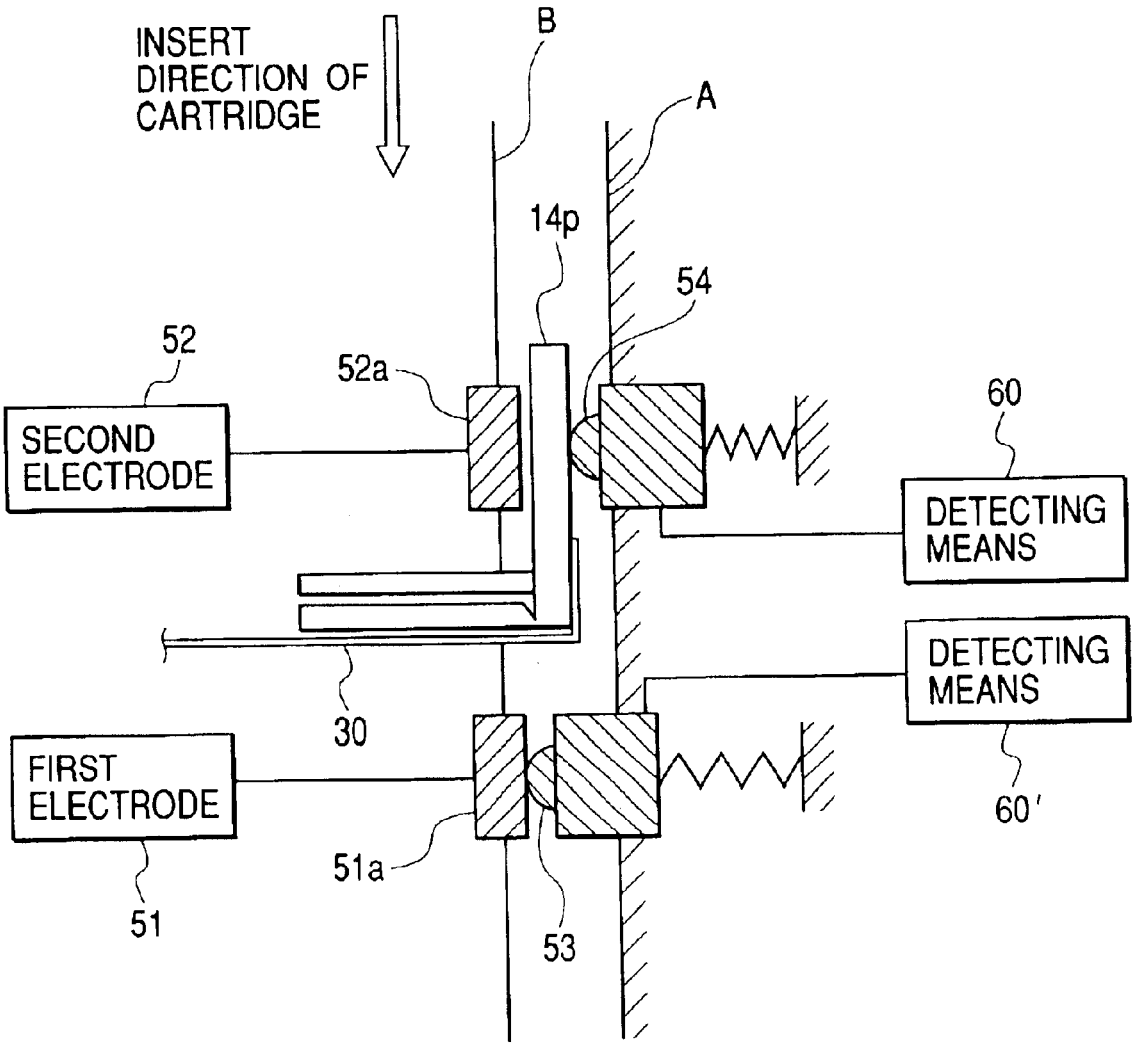
FIG. 10 is a schematic diagram showing the relation between a grip member of a developer seal member and a contact portion of developer amount detecting means when a process cartridge is attached to an image forming apparatus main body without pulling out the developer seal member in an embodiment of the image forming apparatus of the present invention.

At this point, if the developer seal member 30 has not been pulled out of the process cartridge attached to the apparatus main body, no developer has flown into the space between the developing sleeve 11 in the developing container 13 and the first electrode 51. Accordingly, the detecting voltage detected at the first electrode 51 in the developer amount detecting means is at a "developer empty level (x)" shown in FIG. 8. As to the detecting voltage between the developing sleeve 11 and the second electrode 52, the detecting circuit of the second electrode 52 detects that the contact portion 52*a* and the electrical contact portion 54 are in an open state since the contact portion 52*a* of the second electrode 52 and the electrical contact 54 on the apparatus main body side are blocked and insulated from each other by the grip member 14*p* as shown in FIG. 10. In other words, the detecting circuit detects a voltage at a "no cartridge level (y)" in FIG. 8.

When it is thus detected that the detecting voltage between the developing sleeve 11 and the first electrode 51 is at the "developer empty level (x)" and that the detecting voltage between the developing sleeve 11 and the second electrode 52 is at the "no cartridge level (y)", the fact that the developer seal member 30 has not been pulled out is detected and it is judged as so. The subsequent operation is determined based on detection results of the voltage between the developing sleeve 11 and the first electrode 51 and the voltage between the developing sleeve 11 and the second electrode 52. If the "developer empty level (x)" and the "no cartridge level (y)" are not detected, the presence of cartridge and the presence of developer are confirmed to start normal plural forward rotation (Step F109). Thereafter, a main motor is turned ON (Step F110), a charging AC is turned ON (Step F111), and the developing AC is turned ON (Step F112). In Step F113, the residual amount of the developer between the developing sleeve 11 and the second electrode 52 is detected and, in Step F114, the residual amount of the developer between the developing sleeve 11 and the first electrode 51 is detected. If the detection output on the first electrode 51 side tells that there is no developer, "no developer" is displayed in Step F117 to notify a user. If the detection output tells that there is developer, the operation proceeds to Step F115 (where negative transfer is turned ON) and the apparatus enters a stand-by state in Step F116.

If the "developer empty level (x)" and the "no cartridge level (y)" are detected in Step F104, it is judged in Step F105 that there is a developer seal member and "developer seal member exists" is displayed in Step F106 to notify a user of the fact that the developer seal member has not been pulled out. The process cartridge is then taken out of the apparatus main body in Step F107. After the developer seal member is pulled out of the process cartridge in Step F108, the operation returns to Step F101 and the process cartridge from which the developer seal member has been removed is attached to the apparatus main body.

As has been described above, this embodiment takes a structure in which one of the two contact portions in the developer amount detecting means is masked, specifically by covering the contact portion with the grip member of the developer seal member, to cut the electrical connection with the apparatus main body. From the detecting voltage level of the masked contact portion and the detecting voltage level of the other contact portion, the presence or absence of the developer seal member can be detected, thereby achieving the detection with an inexpensive structure in a shorter period. The apparatus of this embodiment prevents, without needing a special detecting member, a developer seal member from being left in place accidentally without being pulled out because it prompts a user to pull out the developer seal member.

Although the description in this embodiment uses the contact portion 52*a* and the electrical contact portion 54 for the second electrode 52, there is no need to stick to these contact portions. Any other structure can be employed as long as a contact portion is structurally covered to cut its electrical connection when the process cartridge is attached to the apparatus main body without pulling out the grip member 14*p* described above.

In the description given in this embodiment, the grip member is a separate member from the developer seal member. However, the grip member and the developer seal member may be formed integrally. Alternatively, the grip member may be formed on the above-described side cover in a manner that allows the grip member to be cut off from the side cover.

Detecting the presence or absence of a developer seal member in the above fashion also allows a process cartridge that is packed with an image forming apparatus prior to shipping of the apparatus to notify a user to pull out the developer seal member, thereby improving the usability.

Figures 12, 12A:
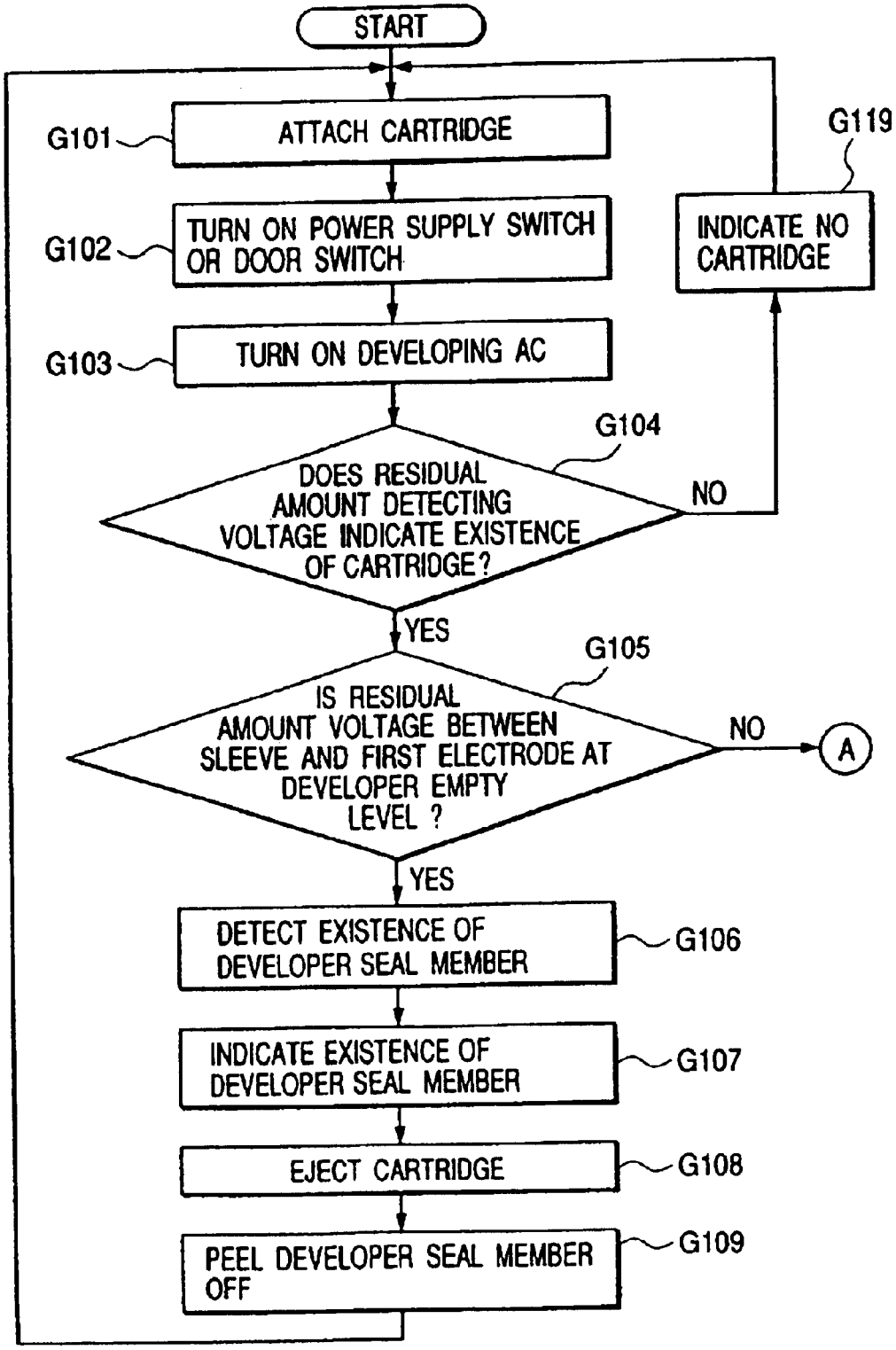
FIG. 12 is comprised of FIGS. 12A and 12B showing a flow chart illustrating another embodiment of a method of detecting the presence or absence of a developer seal member in the image forming apparatus of the present invention.
Figure 12B:
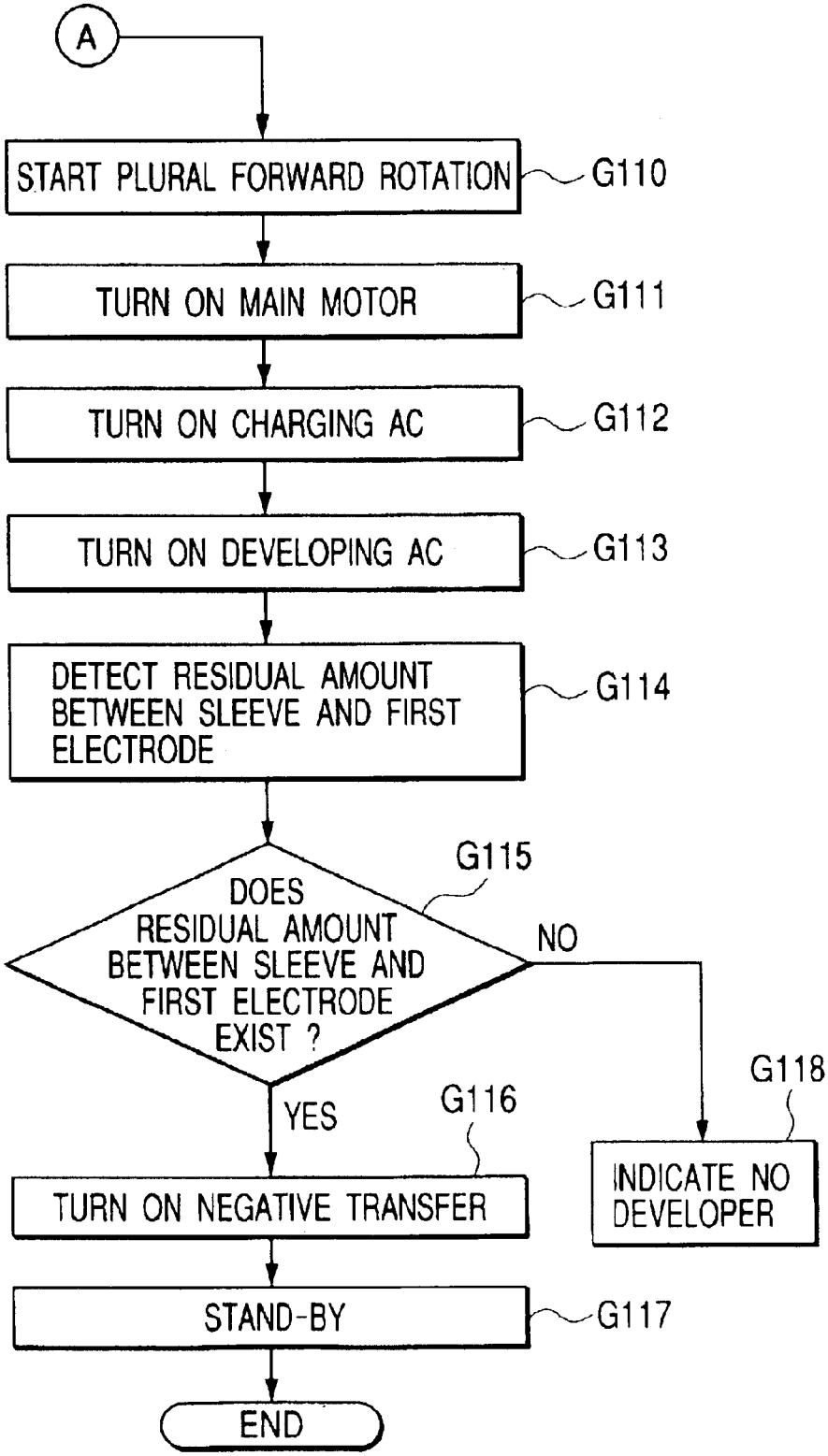

Next, another embodiment for detecting the presence or absence of the developer seal member will be described with reference to FIGS. 12A and 12B.

In this embodiment, the presence or absence of the developer seal member is detected by the above-described developer residual amount detecting method solely from detecting voltage levels without masking a contact portion. In short, this embodiment is different from the above-described embodiment in that a contact portion connected to an electrode is not covered with the grip member 14*p* of the developer seal member 30, but is similar to the above-described embodiment in the structure of the rest of the process cartridge, the developer residual amount detecting circuit, and the developer residual amount detection output characteristic. The following description is given referring to FIGS. 12A and 12B, which show a flow chart of the operation from detection of the presence or absence of the developer seal member according to this embodiment to print stand-by operation.

The process cartridge B is attached to the image forming apparatus main body (Step G101), and a power supply switch is turned ON, or a door switch is turned ON (Step G102). This causes a CPU to output a signal that turns a developing AC ON and a developing AC is applied (Step G103). As a result, the residual amount of the developer between the developing sleeve 11 and the first electrode 51 is detected (Step G104). The subsequent operation is determined based on this detection result. If a voltage at the "no cartridge level (y)" (FIG. 8) is detected, "no cartridge" is displayed in Step G119 to notify a user. If a voltage at the level indicating the presence of the cartridge is detected in Step G104, the residual amount of the developer between the developing sleeve 11 and the first electrode 51 is detected in Step G105. The subsequent operation is varied depending on this detection result. When the "developer empty level (x)" (FIG. 8) is not detected, normal plural forward rotation is started (Step G110). Thereafter, a main motor is turned ON (Step G111), a charging AC is turned ON (Step G112), and the developing AC is turned ON (Step G113). In Step G114, the residual amount of the developer between the developing sleeve 11 and the second electrode 52 is detected and, in Step G115, the residual amount of the developer between the developing sleeve 11 and the first electrode 51 is detected. If the detection output on the first electrode 51 side tells that there is no developer, "no developer" is displayed in Step G118 to notify a user. If the detection output tells that there is developer, the operation proceeds to Step G116 (where negative transfer is turned ON) and the apparatus enters a stand-by state in Step G117.

If the "developer empty level (x)" is detected in Step G105 from the detection of the developer residual amount between the developing sleeve 11 and the first electrode 51, it is judged in Step G106 that there is a developer seal member and "developer seal member exists" is displayed in Step G107 to notify a user of the fact that the developer seal member has not been pulled out. The process cartridge is then taken out of the apparatus main body in Step G108. After the developer seal member is pulled out of the process cartridge in Step G109, the operation returns to Step G101 and the process cartridge from which the developer seal member has been removed is attached to the apparatus main body.

In this embodiment, the presence or absence of the developer seal member can be detected from the developer residual amount detecting voltage level without providing a member that masks a contact portion of the developer amount detecting means. The detection can be achieved by an inexpensive structure in a shorter period without needing a special member. The apparatus of this embodiment prevents, without needing a special detecting member, a developer seal member from being left in place accidentally without being pulled out because it prompts a user to pull out the developer seal member.

Next, still another embodiment for detecting the presence or absence of the developer seal member will be described with reference to FIGS. 13A and 13B.

In the embodiment described above referring to FIGS. 12A and 12B, the presence or absence of the developer seal member is detected solely from developer amount detecting voltage levels. This embodiment is characterized in that the presence or absence of the developer seal member is detected from developer amount detecting voltage levels and from the content of a memory that is a storage medium attached to a process cartridge. The process cartridge of this embodiment has a storage medium memory device provided on the cartridge frame body. In the storage medium memory, information for judging whether the process cartridge is old or new is recorded along with various data including the lot number of the cartridge, initial values of process conditions and the like, situation of use, and characteristics of the image forming apparatus and process means. The rest, namely, the developer residual amount detecting circuit and the developer residual amount detection output characteristics, are similar to those in the above described embodiment.

Figures 13, 13A:
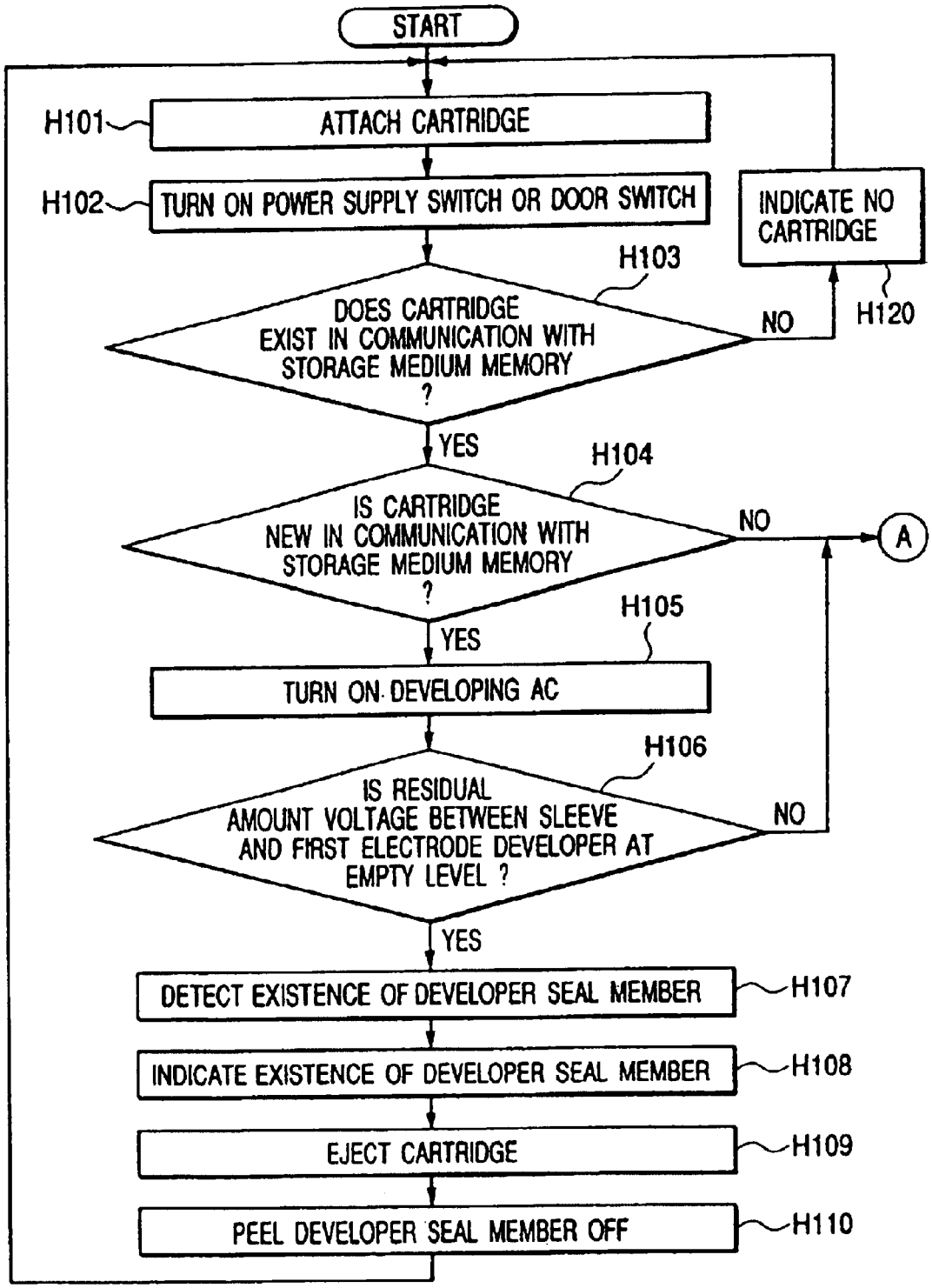
FIG. 13 is comprised of FIGS. 13A and 13B showing a flow chart illustrating still another embodiment of a method of detecting the presence or absence of a developer seal member in the image forming apparatus of the present invention.
Figure 13B:
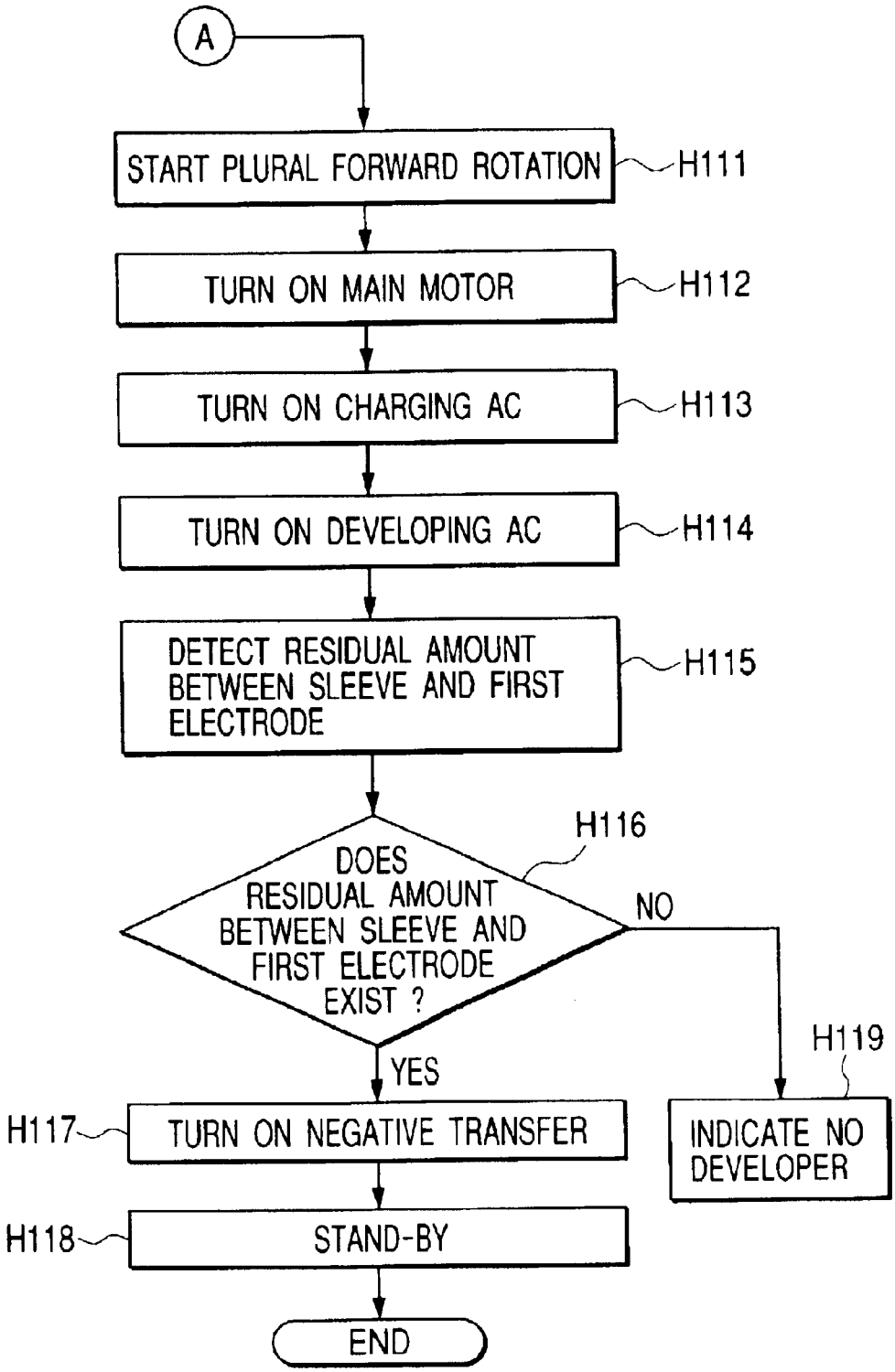

The following description is given referring to FIGS. 13A and 13B, which show a flow chart of the operation from detection of the presence or absence of the developer seal member according to this embodiment to print stand-by operation.

The process cartridge B is attached to the image forming apparatus main body (Step H101), and a power supply switch is turned ON, or a door switch is turned ON (Step H102). In Step H103, communication with the storage medium memory on the cartridge is started. When it is detected through this communication that there is no cartridge, "no cartridge" is displayed in Step H120 to notify a user. If the presence of a cartridge is detected in Step H103, the communication is continued to detect whether or not information of a new cartridge has been stored in Step H104. If the result tells that the attached cartridge is not a new cartridge, it is judged that the developer seal member has been pulled out and the apparatus enters the normal plural forward rotation sequence (Step H111 to Step H114). Then, the residual amount of the developer between the developing sleeve 11 and the second electrode 52 is detected in Step H115 and the residual amount of the developer between the developing sleeve 11 and the first electrode 51 is detected in Step H116. If the detection output on the first electrode 51 side tells that there is no developer, "no developer" is displayed in Step H119 to notify a user. If the detection output tells that there is developer, the operation proceeds to Step H117 (where negative transfer is turned ON) and the apparatus enters a stand-by state in Step H118.

If information of a new cartridge is detected in Step H104, a developing AC is applied (Step H105) and the residual amount of the developer between the developing sleeve 11 and the first electrode 51 is detected (Step H106). The subsequent operation is varied depending on this detection result. When the "developer empty level (x)" is not detected, it is judged that the developer seal member has already been pulled out and the apparatus enters the normal plural forward rotation sequence (Step H111–H119) in a manner similar to the one described above. On the other hand, if the "developer empty level (x)" is detected in Step H106, it is judged in Step H107 that there is a developer seal member and "developer seal member exists" is displayed in Step H108 to notify a user of the fact that the developer seal member has not been pulled out. The process cartridge is then taken out of the apparatus main body in Step H109 and the developer seal member is pulled out of the process cartridge in Step H110. Thereafter, the operation returns to Step H101 and the process cartridge from which the developer seal member has been removed is attached to the apparatus main body.

Yet still another embodiment for detecting the presence or absence of the developer seal member will be described with reference to FIGS. 14A and 14B.

This embodiment is, similar to the embodiment described above referring to FIGS. 13A and 13B, characterized in that the presence or absence of the developer seal member is detected from developer amount detecting voltage levels and from the content of a memory that is a storage medium attached to a process cartridge. This embodiment employs a structure in which one of the two contact portions in the developer amount detecting means is masked, specifically by the grip member of the developer seal member to cover the electrical contact and cut its electrical connection with the apparatus main body.

Figures 14, 14A:
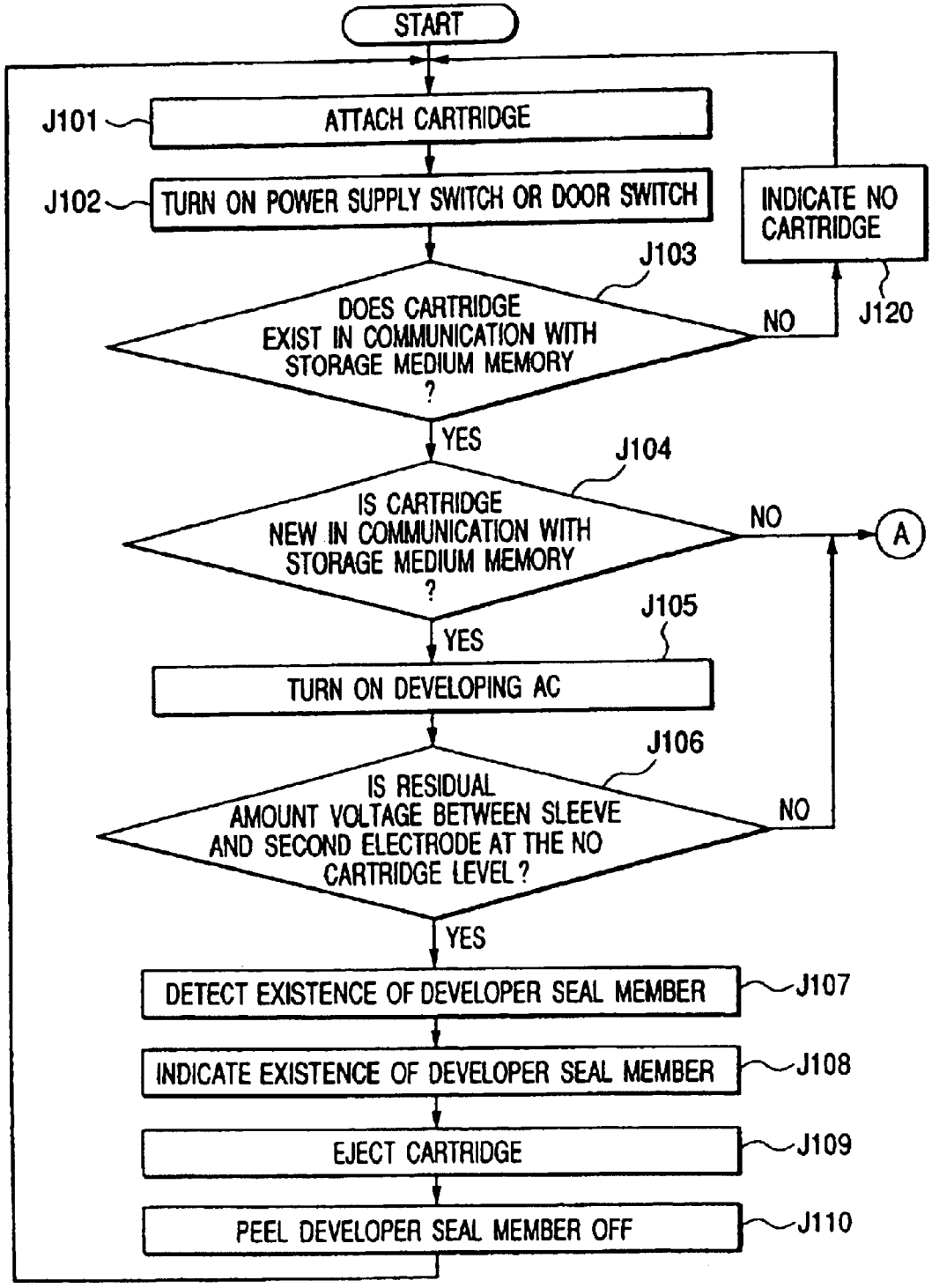
FIG. 14 is comprised of FIGS. 14A and 14B showing a flow chart illustrating yet still another embodiment of a method of detecting the presence or absence of a developer seal member in the image forming apparatus of the present invention.
Figure 14B:
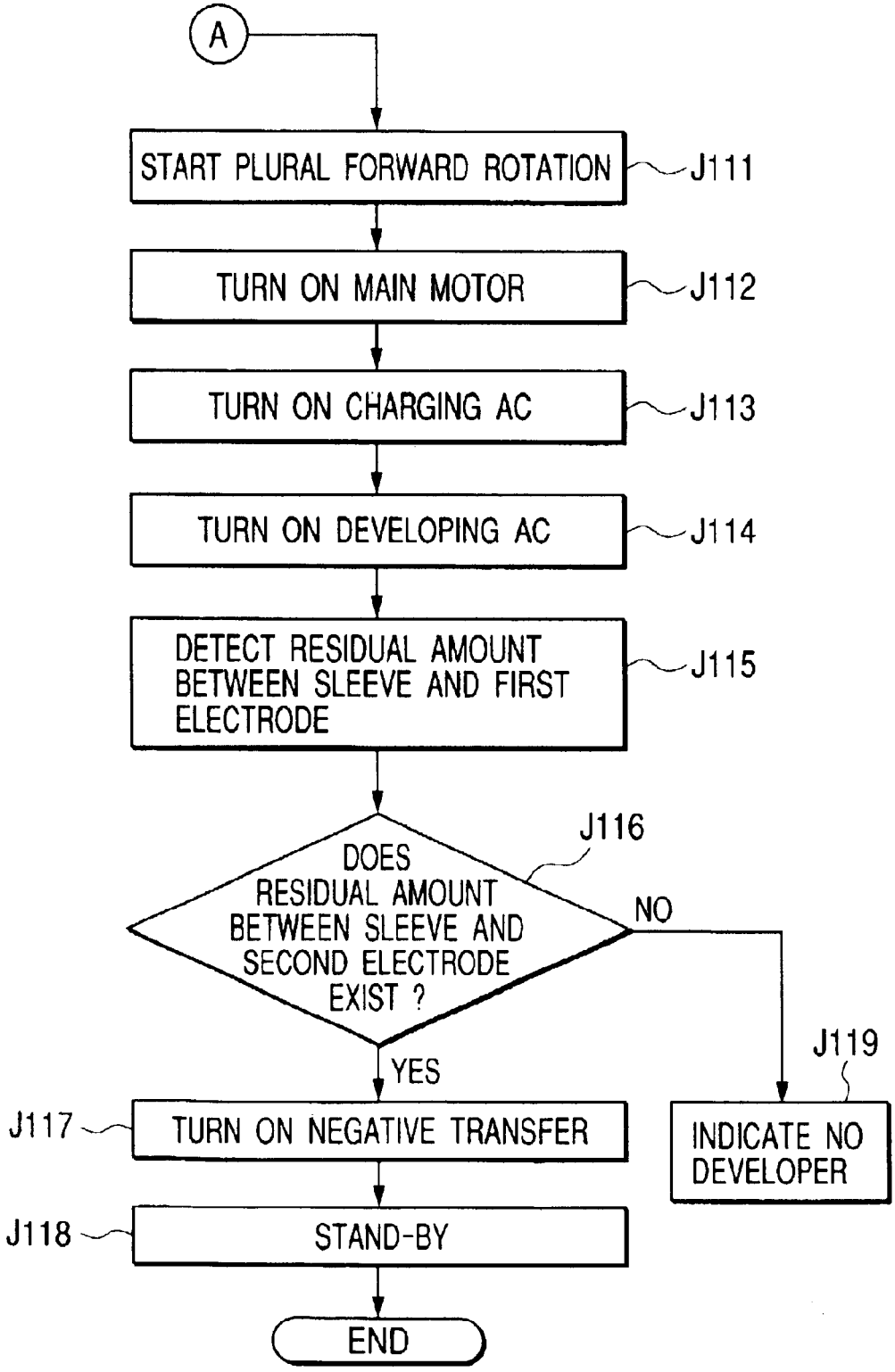

In FIGS. 14A and 14B, after the process cartridge B is attached to the image forming apparatus main body (Step J101) and a power supply switch is turned ON, or a door switch is turned ON (Step J102), communication with the storage medium memory on the cartridge is started in Step J103. If it is detected through this communication that there is no cartridge, "no cartridge" is displayed in Step J120 to notify a user. If the presence of a cartridge is detected in Step J103, the communication is continued to detect whether or not information of a new cartridge has been stored in Step J104. If it is judged from this result that the attached cartridge is not a new cartridge but the one that has been in use, the apparatus enters the normal plural forward rotation sequence (Step J111 to Step J114). If information of a new cartridge is detected in Step J104, a developing AC is applied (Step J105) and the residual amount of the developer between the developing sleeve 11 and the second electrode 52 is detected (Step J106). As to the detecting voltage between the developing sleeve 11 and the second electrode 52, the detecting circuit of the second electrode 52 detects that the contact portion 52*a* and the electrical contact portion 54 are in an open state since the contact portion 52*a* of the second electrode 52 and the electrical contact portion 54 on the apparatus main body side are blocked by the grip member 14*p* as shown in FIG. 10. In other words, the detecting circuit detects a voltage at a "no cartridge level (y)" in FIG. 8. The subsequent operation is varied depending on this detection result. When the "no cartridge level (y)" is not detected, it is judged that the developer seal member has been pulled out and the apparatus enters the normal plural forward rotation sequence (Step J111–Step J119) in a manner similar to the one described above. On the other hand, if the "no cartridge level (y)" is detected in Step J106, it is judged in Step J107 that there is a developer seal member (that is, that the developer seal member has accidentally been left in place without being pulled out) and "developer seal member exists" is displayed in Step J108 to notify a user of the fact that the developer seal member has not been pulled out. The process cartridge is then taken out of the apparatus main body in Step J109 and the developer seal member is pulled out of the process cartridge in Step J110. Thereafter, the operation returns to Step J101 and the process cartridge from which the developer seal member has been removed is attached to the apparatus main body.

As has been described, the presence or absence of the developer seal member can be detected from information in the storage medium memory attached to the process cartridge and from the detecting voltage level of the developer amount detecting means. Therefore the apparatus of this embodiment can shorten the detection time and can prevent, without needing a special detecting member, a developer seal member from being left in place accidentally without being pulled out because it prompts a user to pull out the developer seal member.

In the embodiments described above, conceivable means to notify the fact that the developer seal member has not been pulled out include, in addition to displaying "developer seal member exists" in a display part on the image forming apparatus main body, displaying "pull developer seal member" or like other message that prompts a user to pull out the developer seal member and lighting a warning lamp or the like. It will catch user's attention more easily if a message telling to pull out the developer seal member, or illustration of specifics of the work needed (operation of pulling out the seal), is displayed on the screen of the computer or the like that is used for the image output.

As described above, this embodiment employs a structure in which one of contact portions connected to at least two different electrodes of the developer amount detecting means is masked, specifically, by the grip member of the developer seal member to cover the contact portion and cut its electrical connection with the apparatus main body. This allows the apparatus of this embodiment to detect the presence or absence of the developer seal member from the detecting voltage level of the masked contact portion and from the detecting voltage level of the other contact portion and to shorten the detection time using an inexpensive structure without needing a special member.

In addition, the presence or absence of the developer seal member can be detected from the developer amount detecting voltage levels detected by at least two electrodes in the developer amount detecting means. Therefore the detection can be made accurately by an inexpensive structure without providing a member that masks a contact portion of the developer amount detecting means.

Furthermore, the presence or absence of the developer seal member can be detected from information of the storage medium memory attached to the process cartridge and from the detecting voltage level of the developer amount detecting means. The detection time thus can be shortened even more.

When the presence of the developer seal member is detected, a user is notified of the fact by notifying means and recommended to pull out the developer seal member. In this way, no special detecting member is needed in preventing the developer seal member from being accidentally left in place without being pulled out.

According to the present invention, as has been described, the grip member or the developer seal member covers a contact portion for relaying a signal that is detected by the measuring electrode member to the detecting means when the process cartridge or developing device is attached to the image forming apparatus without removing the developer seal member. Therefore the developer seal member that has been accidentally left in place without being pulled out can be detected without fail.

The present invention can detect without fail the developer seal member that is accidentally left in place without being pulled out by using detecting means for detecting the amount of developer in the developer storing container and the developing frame body instead of dedicated detecting means.

The present invention can prevent the image forming apparatus main body from performing an image forming operation when the developing device or process cartridge is attached to the image forming apparatus main body without removing the developer seal member.

When the developing device or process cartridge is attached to the image forming apparatus main body without removing the developer seal member, the present invention can notify a user of the fact that the developer seal member has not been pulled out and recommend pulling out the developer seal member.

What is claimed is:

1. A process cartridge detachably mountable to an image forming apparatus main body, comprising:

an electrophotographic photosensitive drum;

a developing member configured and positioned to develop a latent image formed on said electrophotographic photosensitive drum;

a developer storing container which stores developer for developing the latent image formed on said electrophotographic photosensitive drum and which has a supplying opening portion configured and positioned to supply the developer to said developing member;

a developer seal member removably attached to said developer storing container so that the developer is sealed in said developer storing container by blocking said supplying opening portion with said developer seal member and is supplied to said developing member by removing said developer seal member from said supplying opening portion;

a grip portion placed on one end in the longitudinal direction of said developer seal member in order to pull out said developer seal member and open said supplying opening portion;

a measuring electrode member configured and positioned to detect the amount of the developer in said process cartridge; and a contact portion electrically connected to a main body electrical contact of the image forming apparatus main body when said process cartridge is attached to the image forming apparatus main body, said contact portion relaying, to the main body electrical contact, a signal sent from said measuring electrode member in accordance with the amount of the developer so that the image forming apparatus main body can detect the developer amount, wherein, when said process cartridge is attached to the image forming apparatus main body without removing said developer seal member, said grip portion covers said contact portion to cut an electrical connection between said contact portion and the main body electrical contact.

2. A process cartridge according to claim 1, wherein said process cartridge further comprises a cover member on one end in the axial direction of said electrophotographic photosensitive drum, and wherein said contact portion is placed on said cover member.

3. A process cartridge according to claim 2, wherein said grip portion and said cover member are integrally formed, and wherein said grip portion is set in a manner that allows said grip portion to be cut off from said cover member while bending said grip portion toward an upstream side of said developer seal member in an attachment direction in which said process cartridge is attached to the image forming apparatus main body.

4. A process cartridge according to claim 3, wherein said process cartridge further comprises a junction portion between said grip portion and said cover member, and wherein said junction portion is thinner than said grip portion and said cover member.

5. A process cartridge according to claim 1, wherein said contact portion is located on an upstream side of said developer seal member in an attachment direction in which said process cartridge is attached to the image forming apparatus main body.

6. A process cartridge according to claim 1, wherein said grip portion and said developer storing container are integrally formed, and wherein said grip portion is set in a manner that allows said grip portion to be cut off from said developer storing container while bending said grip portion toward an upstream side of said developer seal member in an attachment direction in which said process cartridge is attached to the image forming apparatus main body.

7. A process cartridge according to claim 6, wherein said process cartridge further comprises a junction portion between said grip portion and said developer storing container, and wherein said junction portion is thinner than said grip portion and said developer storing container.

8. A process cartridge according to claim 1, wherein said grip portion covers said contact portion while said grip portion bends toward an upstream side of said developer seal member in an attachment direction in which said process cartridge is attached to the image forming apparatus main body.

9. A process cartridge according to claim 1, wherein said grip portion is formed of an insulating material.

10. A process cartridge according to claim 1, wherein said measuring electrode member has a first electrode portion placed in said developer storing container and a second electrode portion placed in a developing frame body configured and positioned to support said developing member, wherein said contact portion has a first contact portion connected to said first electrode portion and a second contact portion connected to said second electrode portion, and wherein, when said process cartridge is attached to the image forming apparatus main body without removing said developer seal member, said grip portion covers at least one of said first contact portion and said second contact portion to cut the electrical connection between said contact portion and the main body electrical contact.

11. A developing device detachably attachable to an image forming apparatus main body, comprising:

a developing member configured and positioned to develop a latent image formed on an electrophotographic photosensitive drum;

a developer storing container which stores developer for developing the latent image formed on the electrophotographic photosensitive drum and which has a supplying opening portion configured and positioned to supply the developer to said developing member;

a developer seal member removably attached to said developer storing container so that the developer is sealed in said developer storing container by blocking said supplying opening portion with said developer seal member and is supplied to said developing member by removing said developer seal member from said supplying opening portion;

a grip portion placed on one end in the longitudinal direction of said developer seal member in order to pull out said developer seal member and open said supplying opening portion;

a measuring electrode member configured and positioned to detect the amount of the developer in said developing device; and a contact portion electrically connected to a main body electrical contact of the image forming apparatus main body when said developing device is attached to the image forming apparatus main body, said contact portion relaying, to the main body electrical contact, a signal sent from said measuring electrode member in accordance with the amount of the developer so that the image forming apparatus main body can detect the developer amount, wherein, when said developing device is attached to the image forming apparatus main body without removing said developer seal member, said grip portion covers said contact portion to cut an electrical connection between said contact portion and the main body electrical contact.

12. A developing device according to claim 11, wherein said developing device further comprises a cover member on one end in the axial direction of the electrophotographic photosensitive drum, and wherein said contact portion is placed on said cover member.

13. A developing device according to claim 11, wherein said contact portion is located on an upstream side of said developer seal member in an attachment direction in which said developing device is attached to the image forming apparatus main body.

14. A developing device according to claim 11, wherein said grip portion and said developer storing container are integrally formed, and wherein said grip portion is set in a manner that allows said grip portion to be cut off said developer storing container while bending said grip portion toward an upstream side of said developer seal member in an attachment direction in which said developing device is attached to the image forming apparatus main body.

15. A developing device according to claim 14, wherein said developing device further comprises a junction portion between said grip portion and said developer storing container, and wherein said junction portion is thinner than said grip portion and said developer storing container.

16. A developing device according to claim 11, wherein said grip portion covers said contact portion while said grip portion bends toward an upstream side of said developer seal member in an attachment direction in which said developing device is attached to the image forming apparatus main body.

17. A developing device according to claim 11, wherein said grip portion is formed of an insulating material.

18. A developing device according to claim 11, wherein said measuring electrode member has a first electrode portion placed in said developer storing container and a second electrode portion placed in a developing frame body configured and positioned to support said developing member, wherein said contact portion has a first contact portion connected to said first electrode portion and a second contact portion connected to said second electrode portion, and wherein, when said developing device is attached to the image forming apparatus main body without removing said developer seal member, said grip portion covers at least one of said first contact portion and said second contact portion to cut the electrical connection between said contact portion and the main body electrical contact.

19. An image forming apparatus with a detachable process cartridge for forming an image on a recording medium, comprising:

(i) a main body electrical contact;

(ii) detecting means;

(iii) an attachment portion to which said process cartridge is detachably attachable;

(iv) said process cartridge, wherein said process cartridge is attached to said attachment portion, said process cartridge comprising:

an electrophotographic photosensitive drum;

a developing member configured and positioned to develop a latent image formed on said electrophotographic photosensitive drum;

a developer storing container which stores developer for developing the latent image formed on said electrophotographic photosensitive drum and which has a supplying opening portion configured and positioned to supply the developer to said developing member;

a developer seal member removably attached to said developer storing container so that the developer is sealed in said developer storing container by blocking said supplying opening portion with said developer seal member and is supplied to said developing member by removing said developer seal member from said supplying opening portion;

a grip portion placed on one end in the longitudinal direction of said developer seal member in order to pull out said developer seal member and open said supplying opening portion;

a measuring electrode member configured and positioned to detect the amount of the developer in said process cartridge; and a contact portion electrically connected to said main body electrical contact when said process cartridge is attached to a main body of said image forming apparatus, said contact portion relaying, to said main body electrical contact, a signal sent from said measuring electrode member in accordance with the amount of the developer so that said detecting means can detect the developer amount, said contact portion being covered with said grip portion to cut an electrical connection between said contact portion and said main body electrical contact when said process cartridge is attached to said image forming apparatus main body without removing said developer seal member; and (v) convey means for conveying the recording medium.

20. An image forming apparatus with a detachable developing device for forming an image on a recording medium, comprising:

(i) a main body electrical contact;

(ii) detecting means;

(iii) an attachment portion to which said developing device is detachably attachable;

(iv) said developing device, wherein said developing device is attached to said attachment portion, said developing device comprising:

a developing member configured and positioned to develop a latent image formed on an electrophotographic photosensitive drum;

a developer storing container which stores developer for developing the latent image farmed on the electrophotographic photosensitive drum and which has a supplying opening portion configured and positioned to supply the developer to said developing member;

a developer seal member removably attached to said developer storing container so that the developer is sealed in said developer storing container by blocking said supplying opening portion with said developer seal member and is supplied to said developing member by removing said developer seal member from said supplying opening portion;

a grip portion placed on one end in the longitudinal direction of said developer seal member in order to pull out said developer seal member and open said supplying opening portion;

a measuring electrode member configured and positioned to detect the amount of the developer in said developing device; and a contact portion electrically connected to said main body electrical contact when said developing device is attached to a main body of said image forming apparatus, said contact portion relaying, to said main body electrical contact, a signal sent from said measuring electrode member in accordance with the amount of the developer so that said detecting means can detect the developer amount, said contact portion being covered with said grip portion to cut an electrical connection between said contact portion and said main body electrical contact when said developing device is attached to said image forming apparatus main body without removing said developer seal member; and (v) convey means for conveying the recording medium.

* * * * *

UNITED STATES PATENT AND TRADEMARK OFFICE

CERTIFICATE OF CORRECTION

PATENT NO. : 6,804,476 B2
DATED : October 12, 2004
INVENTOR(S) : Akiyoshi Yokoi et al.

It is certified that error appears in the above-identified patent and that said Letters Patent is hereby corrected as shown below:

Column 1,
Line 13, “and” should read -- and an --.
Line 18, “photography” should read -- photographic --.
Line 23, “integrating” should read -- integrating an --.
Line 27, “Image” should read -- An image -- and “electrophotography” should read -- electrophotographic --.
Line 36, “Such” should read -- Such an --.
Line 57, “time” should read -- the time --.
Line 66, “In” should read -- In an -- and “of” should read -- employing --.

Column 2,
Line 10, “mend” should read -- mend to --.
Line 18, “time of use.” should read -- the time for use thereof --.
Line 34, “and main” should read -- main --.
Line 53, “image” should read -- the image --.
Line 62, “process” should read -- a process -- and “and” should read -- and an --.
Line 65, “and” should read -- and a --.

Column 3,
Line 4, “process” should read -- a process -- and “and” should read -- and an --.
Line 6, “dedicated” should read -- a dedicated --.
Lines 14 and 20, “process” should read -- a process -- and “and” should read -- and an --.

Column 5,
Line 53, “showing” should read -- showing the --.
Line 60, “and” should read -- and the -- and “by” should read -- by the --.

Column 6,
Line 7, “of” should read -- of the --.
Line 35, “given” should read -- provided --.
Line 39, “electrophotography” should read -- electrophotographic --.

Column 8,
Line 65, “15-2” should read -- 15-2, --.
Line 66, “13” should read -- 13, --,

UNITED STATES PATENT AND TRADEMARK OFFICE

CERTIFICATE OF CORRECTION

PATENT NO. : 6,804,476 B2
DATED : October 12, 2004
INVENTOR(S) : Akiyoshi Yokoi et al.

It is certified that error appears in the above-identified patent and that said Letters Patent is hereby corrected as shown below:

Column 9,
Line 4, “not be” should read -- are not to be --.
Line 27, “supply” should read -- the supply --.
Line 51, “53” should read -- 53, -- and “52a” should read -- contact portion 52a --.
Line 53, “given” should read -- provided --.

Column 11,
Line 13, “affect” should read -- affect the -- and “developer” should read -- developer, --.
Line 19, “result,” should read -- result, a --.
Line 59, “namely,” should read -- namely, a --.

Column 12,
Line 8, “contacts” should read -- contact portions --.
Line 14, “53” should read -- portion 53 --.
Line 16, “and” should read -- and the --.
Line 20, “the” should read -- when the --.
Line 36, “in” should read -- in the --.
Line 49, “way,” should read -- way, the --.

Column 13,
Line 29, “portion” should be deleted.
Line 51, “and” should read -- and is --.
Line 52, “about” should read -- about a --.
Line 64, “member” should read -- member, -- and “therefore” should read -- therefore, --.
Line 67, “cost.” should read -- the cost. --.

Column 14,
Line 3, “electrode” should read -- electrode, --
Line 5, “on” should read -- on the -- and “14p” should read -- 14p, --.
Line 9, “that it” should be deleted.
Line 15, “30” should read -- 30, -- and “outside” should read -- outside, --.
Line 23, “53” should read -- portion 53 --.
Line 26, “54” should read -- portion 54 --.
Line 27, “portions” should read -- portion --.
Line 42, “next” should read -- next, --.
Line 43, “11B are” should read -- 11B, is -- and “which” should read -- that --.
Line 45, “which” should be deleted and “with” should read -- with a --.
Line 59, “flown” should read -- flowed --.

UNITED STATES PATENT AND TRADEMARK OFFICE

CERTIFICATE OF CORRECTION

PATENT NO. : 6,804,476 B2
DATED : October 12, 2004
INVENTOR(S) : Akiyoshi Yokoi et al.

It is certified that error appears in the above-identified patent and that said Letters Patent is hereby corrected as shown below:

Column 15,
Line 12, “judged as so.” should read -- determined as such. --
Line 17, “of” should read -- of the --.
Line 26, “tells” should read -- indicates --.
Line 27, ““no” should read -- a “no -- and “is” should read -- message is --.
Line 28, “tells” should read -- indicates --.
Line 32, “judged” should read -- determined --.
Line 33, “and” should read -- and the message --.
Line 66, “in” should read -- for --.

Column 16,
Line 10, “the” should be deleted.
Line 27, “from” should read -- from the --.
Line 29, “print” should read -- a print --.
Line 39, ““no cartridge”” should read -- a “no cartridge” message --
Line 54, “tells” should read -- indicates --.
Line 55, “no developer” should read -- a “no developer” message --.
Line 56, “tells” should read -- indicates --.
Line 64, “judged” should read -- determined --.
Line 65, “and” should read -- and a -- and “is” should read -- message is --.

Column 17,
Line 33, “like,” should read -- like, the --.
Line 34, “and” should read -- and the --.
Line 38, “above described” should read -- above-described --.
Line 42, “print” should read -- a print --.
Line 50, ““no” should read -- a “no --.
Line 54, “tells” should read -- indicates --.
Line 55, “judged” should read -- determined --.
Line 63, “tells” should read -- indicates -- and
“no developer” should read -- a “no developer” message --.
Line 65, “tells” should read -- indicates --.

UNITED STATES PATENT AND TRADEMARK OFFICE

CERTIFICATE OF CORRECTION

PATENT NO. : 6,804,476 B2
DATED : October 12, 2004
INVENTOR(S) : Akiyoshi Yokoi et al.

It is certified that error appears in the above-identified patent and that said Letters Patent is hereby corrected as shown below:

Column 18,
Lines 6 ,11, 46 and 64, “judged” should read -- determined --.
Line 12, “and” should read -- and the -- and “is” should read -- message is --.
Line 28, “from” should read -- from the --.
Line 42, ““no cartridge”” should read -- a “no cartridge” message --.
Line 49, “J114).” should read -- J119). --.

Column 19,
Line 2, “judged” should read -- determined --.
Line 4, “and” should read -- and a --.
Line 5, “is” should read -- message is --.
Line 23, “notify the” should read -- notify the user of the --.
Line 24, “displaying” should read -- displaying a --.
Line 25, “in” should read -- message in --.
Line 26, “displaying” should read -- displaying a --.
Line 27, “or” should read -- message or --.
Line 49, “Therefore” should read -- Therefore, --.

Signed and Sealed this

Twenty-second Day of February, 2005

JON W. DUDAS
*Director of the United States Patent and Trademark Office*